US011462874B2

(12) United States Patent
Weisheit et al.

(10) Patent No.: US 11,462,874 B2
(45) Date of Patent: Oct. 4, 2022

(54) CRIMPING PLIERS

(71) Applicant: Rennsteig Werkzeuge GmbH, Steinbach-Hallenberg (DE)

(72) Inventors: Benjamin Weisheit, Floh-Selingenthal (DE); Georg Holland-Moritz, Steinbach-Hallenberg (DE); Gerhard Koenig, Steinbach-Hallenberg (DE); Marko Endter, Steinbach-Hallenberg (DE); Ralf Legler, Altersbach (DE)

(73) Assignee: Rennsteig Werkzeuge GmbH, Steinbach-Hallenberg (DE)

( * ) Notice: Subject to any disclaimer, the term of this patent is extended or adjusted under 35 U.S.C. 154(b) by 388 days.

(21) Appl. No.: 16/758,099

(22) PCT Filed: Nov. 7, 2018

(86) PCT No.: PCT/EP2018/080470

§ 371 (c)(1),
(2) Date: Apr. 22, 2020

(87) PCT Pub. No.: WO2019/105704

PCT Pub. Date: Jun. 6, 2019

(65) Prior Publication Data

US 2020/0251869 A1 Aug. 6, 2020

(30) Foreign Application Priority Data

Dec. 1, 2017 (DE) ..... 10 2017 128 584.9

(51) Int. Cl.
*H01R 43/042* (2006.01)

(52) U.S. Cl.
CPC ..... *H01R 43/042* (2013.01); *Y10T 29/53226* (2015.01)

(58) Field of Classification Search
CPC ..... H01R 43/042; Y10T 29/49181; Y10T 29/49183; Y10T 29/49185;
(Continued)

(56) References Cited

U.S. PATENT DOCUMENTS 2,109,837 A 3/1938 Davis
3,067,489 A 12/1962 Hoffman
(Continued)

FOREIGN PATENT DOCUMENTS

DE 198 18 482 C1 11/1999
DE 102 42 345 B3 2/2004
(Continued)

OTHER PUBLICATIONS

International Search Report of PCT/EP2018/080470, dated Jan. 24, 2019.
(Continued)

*Primary Examiner* — Peter Dungba Vo
*Assistant Examiner* — Joshua D Anderson
(74) *Attorney, Agent, or Firm* — Collard & Roe, P.C.

(57) ABSTRACT

A pair of crimping pliers for crimping, in particular for crimp joining, workpieces, has two oppositely arranged pressing jaws and two pliers jaws, wherein one pliers jaw is stationary and the associated pressing jaw is fastened to this stationary pliers jaw by means of a spring-loadable holder part. The holder part is fixedly connected at its end farthest from the pressing jaw to the pliers jaw. Between the stationary connection and the end of the holder part closest to the first pressing jaw, a stop connection is formed between the stationary pliers jaw and the holder part and comes into effect when a predetermined pressing force is exceeded.

9 Claims, 19 Drawing Sheets

(58) Field of Classification Search
CPC ..... Y10T 49/53226; B25B 7/12; B25B 7/18; B25B 27/146
See application file for complete search history.

(56) References Cited

U.S. PATENT DOCUMENTS

| | | | | |
|---|---|---|---|---|
| 4,283,933 | A | 8/1981 | Wiener | |
| 5,117,671 | A | 6/1992 | Aikens et al. | |
| 5,228,325 | A | 7/1993 | Wiebe et al. | |
| 6,151,950 | A | 11/2000 | Wilhelm et al. | |
| 6,176,116 | B1 | 1/2001 | Wilhelm et al. | |
| 6,910,363 | B2 | 6/2005 | Beetz et al. | |
| 2017/0170618 | A1* | 6/2017 | Ho | B25B 27/146 |
| 2020/0223041 | A1* | 7/2020 | Ullbors | B25B 7/14 |

FOREIGN PATENT DOCUMENTS

| | | | |
|---|---|---|---|
| EP | 0 516 598 | A1 | 12/1992 |
| EP | 0 471 977 | B1 | 6/1995 |
| EP | 0 732 779 | B1 | 9/1998 |
| EP | 3 179 580 | A1 | 6/2017 |
| FR | 2 886 874 | A1 | 12/2006 |

OTHER PUBLICATIONS

International Search Report of PCT/EP2018/080469, dated Apr. 12, 2019.

* cited by examiner

CRIMPING PLIERS

CROSS REFERENCE TO RELATED APPLICATIONS

This application is the National Stage of PCT/EP2018/080470 filed on Nov. 7, 2018, which claims priority under 35 U.S.C. § 119 of German Application No. 10 2017 128 584.9, filed on Dec. 1, 2017, the disclosure of which is incorporated by reference. The international application under PCT article 21(2) was not published in English.

FIELD OF TECHNOLOGY

The invention relates to crimping pliers for crimping, in particular crimp joining, workpieces having two oppositely arranged pressing jaws and two pliers jaws, wherein one pliers jaw is stationary and the associated pressing jaw is fastened to this stationary pliers jaw by means of a spring-loadable holder part, wherein the holder part is fixedly connected to the pliers jaw at its end facing away from the pressing jaw.

PRIOR ART

Crimping pliers of the type in question are known, further in particular in the configuration as manually operated crimping pliers. These are used in particular for attaching and joining so-called core end sleeves at cable ends. Such crimping pliers are provided with fixedly arranged or replaceable pressing jaws, which are movable toward one another in the manner of pliers. The pressing jaws act in this case in the manner of a notching die for forming crimping of the body inserted between the pressing jaws. Reference is made, for example, to EP 732 779 B1 (U.S. Pat. No. 6,176,116 B1) and to DE 198 18 482 C1 (U.S. Pat. No. 6,151,950 A).

Furthermore, such in particular manually operable crimping pliers are suitable for crimping blanks in different cross-sectional dimensions, preferably using the same pressing jaws. Since the working path for the user in the course of the displacement of the pliers jaws should always remain at least approximately the same, optionally must furthermore be the same, depending on a lever geometry, a force-path compensation to be brought about inside the pliers is required for crimping cross-sections of various sizes using the same pressing jaws. According to EP 732 779 B1, this is achieved by providing a spring lever fixedly connected at one end to a pliers jaw. According to DE 198 18 482 C1, a transmission lever is provided for this, which supports one of the pressing jaws.

Known from EP 3179580 A1 are crimping pliers, in which, upon actuation of a stop connection, a greater bending is achieved between the stop connection and the fixed connection of the holder part. A relatively large change in the assignment of the handle regions can be obtained during crimping. Known from DE 10242345 B3 are crimping pliers, which have a stop in the sense of an overload protection. In usual usage this stop connection is not activated.

SUMMARY OF THE INVENTION

Starting from the described prior art, the invention is concerned with the object of providing crimping pliers of the type mentioned, which are configured advantageously with regard to a force-path compensation for crimping cables having different diameter.

This object is achieved in the crimping pliers according to the invention, wherein the focus is on the fact that upon activating a stop connections, a further action of pressing force gives a greater bending between the stop connection and the pressing-jaw-side end than in the holder part section obtained in this stop position between the stop connection and the fixed connection.

As a result of this configuration, crimping pliers are provided, by means of which blanks having various cross-sections can be crimped, thus for example, cross-sections starting from about 0.05 $mm^2$ as far as about 16 $mm^2$ or 20 $mm^2$. These crimpings can thus fundamentally be carried out without any adaptation of the crimping pliers, which particularly needs to be carried out, namely preferably without any change of the pressing jaws and furthermore preferably without any adjustment, in particular adjustment, which needs to be carried out manually. With such a large cross-sectional range, very different displacement paths are obtained directly in the region of the pressing jaws or the end regions of the pliers jaws holding the pressing jaws, which displacement paths must be compensated while desirably maintaining the same displacement paths of the pliers jaws handle regions to be actuated by the user. As a result of the configuration of a stop connection between the fixed connection of the holder part and the pliers jaws, and the end of the holder part facing the associated pressing jaw, a change in the effective lever arm in the region of the holder part can be achieved when a predetermined pressing force is exceeded. Thus, the holder part can initially be bent in a restorable manner over its entire length between the fixed connection and the pressing-jaw-side end as a result of the intrinsic elasticity of the material whereafter during a further action of pressing force, the holder part section obtained between the stop connection and the pressing-jaw-side end undergoes a greater bending than the holder part section obtained in this stop position between the stop connection and the fixed connection. This can optionally have the effect that a further bending is only achieved in the region of the holder part extending resiliently beyond the stop connection (accordingly between stop connection and pressing-jaw-side end).

As a result of the configuration of a stop connection, a reduction of the effective lever arm is substantially obtained in the course of exceeding a predetermined pressing force, starting from a lever arm between the pressing-jaw-side end and substantially the region of the fixed connection of the holder part to the pliers jaw into a shortened lever arm between the pressing-jaw-side end and the stop connection.

According to a further development, it can be provided that the stop connection is formed by a stop section of the pliers jaw, which comes to abut against the holder part as a result of a bending deformation of the holder part in the course of an application of pressing force. The pliers-jaw-side stop section extends accordingly preferably in the bending region of the holder part, for possible cooperation with a facing surface of the holder part, for example, a marginal edge surface of the holder part. In the stop position, the stop section of the pliers jaw affords the holder part a support, spaced apart both from the fixed connection with the pliers jaw and also spaced apart from the free end of the holder part carrying the pliers jaw. Thus, with reference to a greatest direction of longitudinal extension of the holder part, the stop section can act against the holder part approximately in a central third between the fixed connection with the pliers jaw and the free end of the holder part carrying the pressing jaw.

The stop section can be configured as a pin received in a slot of the holder part. In the case of such a configuration, and also preferably, the relevant slot can be formed in the holder part. Accordingly, the then pliers-jaw-side pin can then come to abut against a boundary section of the slot as a result of a bending deformation of the holder part in the course of an application of pressing force. Also, as preferably, the slot can be aligned accordingly adapted to a bending direction of the holder part viewed from the pin. Furthermore, the pin can also be formed on the holder pin for cooperation with a pliers-jaw-side slot.

A smallest cross-section of the holder part between the fixed connection and the stop section can preferably be selected to be larger than a smallest cross-section between the stop section and the holder region of the holder part for the associated pressing jaw. In this case, with reference to the smallest cross-section, a dimension or an area is considered which is obtained when viewed in the direction of displacement or the pin or the slot of the stop connection. Thus, in the region extending over the stop section as far as the end section of the holder part holding the pressing jaw, an optionally also overall more slender configuration of the holder part in terms of cross-section is obtained compared to the holder part section given between the stop section and the fixed connection region. Thus, the respectively smallest cross-section can furthermore be obtained in particular in each case approximately centrally to the previously described holder part regions, further preferably approximately in a central third of the respective holder part region, relative to a greatest direction of longitudinal extension of the holder part, furthermore optionally in a respectively outer third of the respective holder part region starting from the fixed connection, optionally going over into the central third of the holder part region.

Thus, furthermore in a region between ⅓ and ⅔ of the distance between the stop section and the fixed connection or between the holder region and the stop section, an effective bending cross-section of the holder part can be 10%, for example, up to 50% or further up to 80% larger than in the region of the smallest cross-section, this being observed preferably over the entire length of the holder part between the fixed connection and the end section carrying the pressing jaw and further observed in a side view, in which the greatest length of the holder part relative to a horizontal is observed. The bending cross-section is preferably obtained along a vertical in relation to a greatest direction of longitudinal extension of the holder part.

In one possible embodiment, the holder part can be configured as a flat part having a smaller thickness compared with its length. Thus, the length of the holder part in the direction of longitudinal extension can, for example, correspond to 10 to 50 times, further approximately to 25 to 40 times the thickness of the flat part observed perpendicular to this. The smallest cross-section of the holder part can correspond dimensionally to 1 to 5 times the holder part thickness.

In the unloaded state with respect to a geometric central longitudinal line, the holder part can have a concave profile when viewed from the movable pliers jaw. Accordingly, the holder part overall, but substantially with reference to the central longitudinal line, can run in an arcuate curved manner, optionally in this case having a radius, which remains the same throughout in relation to the curvature, but furthermore also having different radii in relation to the curvature over the length of the central longitudinal line.

The movable pliers jaw can be mounted on the stationary pliers jaw and on a movable handle part by means of a continuously uniform-material lever part. Furthermore the movable pliers jaw can have a free end region for holding receipt of the second pressing jaw. The lever part can be pivoted about the axis of rotation in the region of the stationary pliers jaw as a result of a customary handle part pivoting displacement for corresponding sliding displacement of the provided second pressing jaw in the direction of the opposite first pressing jaw of the stationary pliers jaw. For favorable force transmission, a so-called toggle joint can be provided in this regard.

Furthermore, in relation to the lever part of the movable pliers jaw in a region between ⅓ and ⅔ of the distance between the mounting of the lever part on the stationary pliers jaw and the mounting of the lever part on the movable handle part or between the mounting of the lever part on the stationary pliers jaw and the free end region of the lever part, a region of greatest deformation can be obtained when a pressing force is applied. Accordingly, furthermore the lever part of the movable pliers jaw can also be configured to be resilient overall or in sections, wherein in a preferred embodiment the resilience is obtained merely from the material elasticity value of the lever part.

Thus, according to one possible embodiment, both holder or lever parts forming the holder receptacle for a pressing jaw can bend out resiliently to compensate for the force path when a predetermined pressing force is exceeded.

BRIEF DESCRIPTION OF THE DRAWINGS

The invention is explained hereinafter in detail with reference to exemplary embodiments. In the drawings.

DESCRIPTION OF THE EMBODIMENTS

Figure 1:
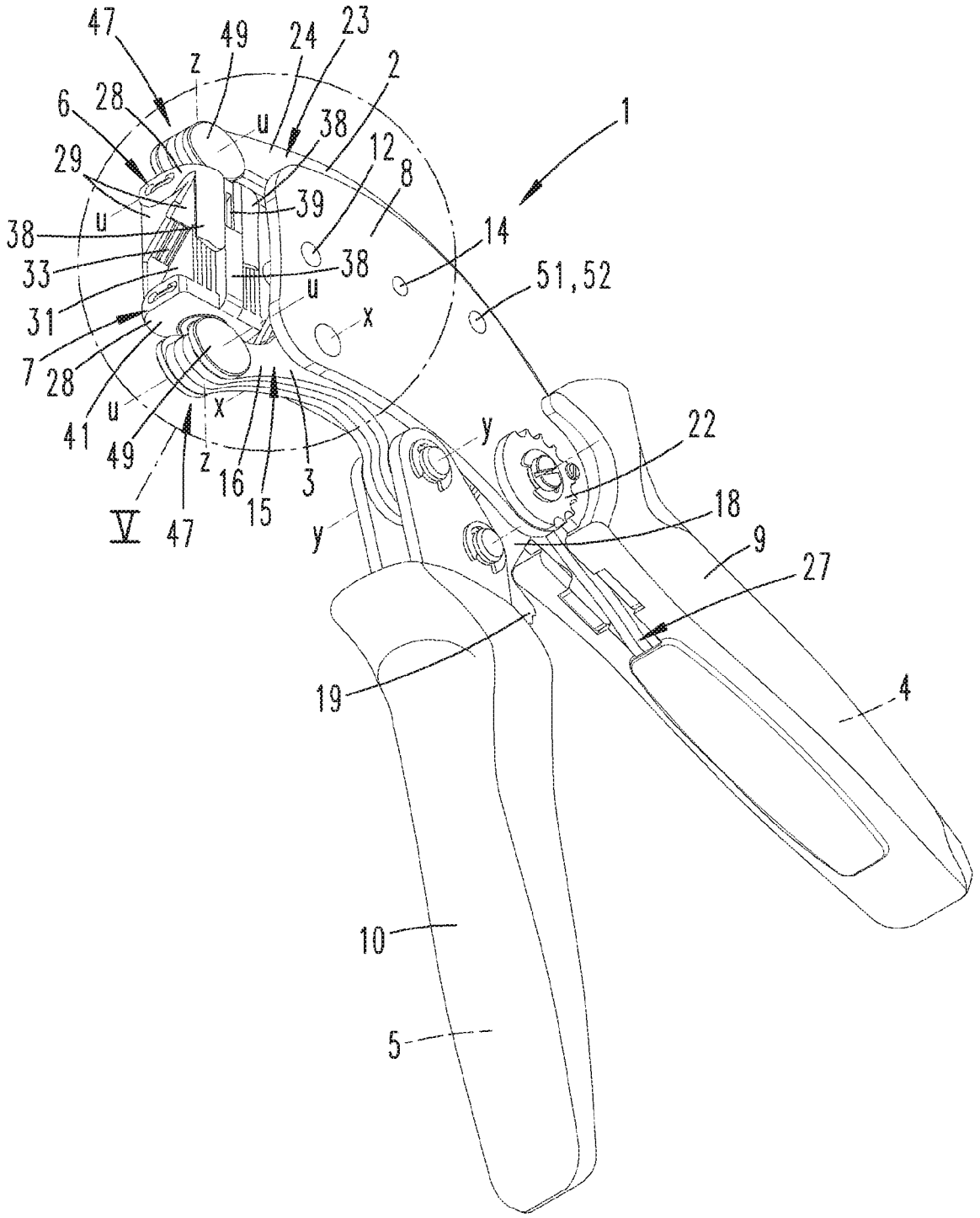
FIG. 1 shows in a perspective diagram crimping pliers in a pressing mouth open position.

Shown and described initially with reference to FIG. 1 are crimping pliers 1, which substantially comprise two pliers jaws 2, 3, two handle parts 4, 5, and a first pressing jaw 6 and a second pressing jaw 7, which are arranged opposite one another as a pressing jaw pair.

The pliers jaw 2 and the associated handle part 4 are hereinafter further designated in each case as stationary, whereas the pliers jaw 3 and the handle part 5 associated with this is further designated as movable.

The first pressing jaw 6 is associated with the stationary pliers jaw 2, whereas the movable pliers jaw 3 carries the second pressing jaw 7.

The stationary pliers jaw 2 is substantially composed of two substantially identically configured jaw parts 8, which are spaced apart from one another transversely to the longitudinal extension of the pliers jaw 2, which jaw parts go over at the ends into the region facing away from the pressing jaws 6 and 7 into the handle part 4 rigidly connected to the pliers jaw 2 thus configured. The handle part can, as is also the case with the moving handle part 5, be embraced by a handle sleeve 9 or 10.

The movable pliers jaw 3 is held rotatably about a geometric axis of rotation x on the stationary pliers jaw 2, wherein a rotary open position is stop-limited as a result of a support of a stop section 11 of the movable pliers jaw 3 on a section of the stationary pliers jaw 2, for example, as shown, on a pin 12 extending between the jaw parts 8 of the stationary pliers jaw 2 in the direction of extension of the axis of rotation x.

The axis of rotation x runs substantially transversely directed to the longitudinal direction of extension in particular of the stationary pliers jaw 2 and the adjoining handle part 4.

Furthermore, the movable pliers jaw 3 is acted upon by a spring in the direction of its stop-limited rotary open position. For this purpose, in the exemplary embodiment shown, a spring 13 is provided, preferably as shown in the form of a cylinder tension spring, which acts on a lever end of the movable pliers jaw 3 facing away from the associated second pressing jaw 7. The end of the spring 13 facing away from the pliers jaw 3 is connected to a further pin 14 of the stationary pliers jaw 2.

Lever sections facing away from one another extend substantially starting from the geometric axis of rotation x, thus a lever section projecting substantially in the direction of the handle part 5, at the end of which the spring 13 acts, and a lever section facing away from the handle part 5, directed in a direction of a front side of the crimping pliers 2, on the end region of which the associated second pressing jaw 7 is held.

Overall the movable pliers jaw 3 in the depicted exemplary embodiment is preferably formed by a continuously material-uniform plate-like lever part 15.

Furthermore, the movable handle part 5 is substantially articulated at the end of the lever section 17 upon which the spring 13 acts. The relevant geometric axis of rotation y extends in parallel alignment to the geometric axis of rotation x of the movable pliers jaw 3. Combined with a ratchet arm 18, this results in a knee joint arrangement K relating to the articulation of the handle part 5 and the action via the handle part 5 on the pliers jaw 3.

For this purpose, at one end the ratchet arm 18 is articulated to the stationary pliers jaw 2 and at the other end, to the movable handle part 5. The relevant geometric axes of rotation each run parallel to the geometric axis of rotation x, and also to the geometric axis of rotation y.

A toothed ratchet section 19 is formed on the ratchet arm 18 for cooperation with a pivotably articulated pawl 20 on the movable handle part 5 upon actuation of the crimping pliers 1. Said pawl is spring-pre-tensioned into a base position as a result of the arrangement of a tension spring 21 in the movable handle part 5.

In a known manner, an adjustment of the knee joint arrangement K is made possible by an actuator 22, which is accessible from outside on the stationary pliers jaw 2 and which is rotatable about the geometric axis of rotation, about which the ratchet arm 18 is also movable in the region of the stationary pliers jaw 2, which actuator can be fixed in a latched manner in several rotational positions. The actuator 22 acts on the fixed-jaw-side of the axis of rotation of the ratchet arm 18 via an eccentric not shown, so that by this means a corresponding linear displacement of the relevant geometric axis of rotation can be achieved.

The first pressing jaw 6 is fixed at the end of a resilient holder part 23. With regard to a central line a of the holder part 23 running substantially in the longitudinal extension of the stationary pliers jaw 2 and its extension into the fixed handle part 4, when viewed from the movable pliers jaw 3 or the movable handle part 5, a substantially concave profile is obtained, in particular in the region of a holder part section 24 between the free end holding the first pressing jaw 6 and a stop connection 25 described in more detail hereinafter.

The holder part 23 is preferably flanked on both sides by the jaw parts 8 of the stationary pliers jaw 2, wherein the holder part section 26 facing away from the end carrying the first pressing jaw 6 is connected at the end to the stationary pliers jaw 2, accordingly to the jaw parts 8 and/or the fixed handle part 4. In the depicted exemplary embodiment, a fixed connection 27 is given in this respect by two pin connections spaced apart from one another in the direction of extension of the central line a.

Figure 5:
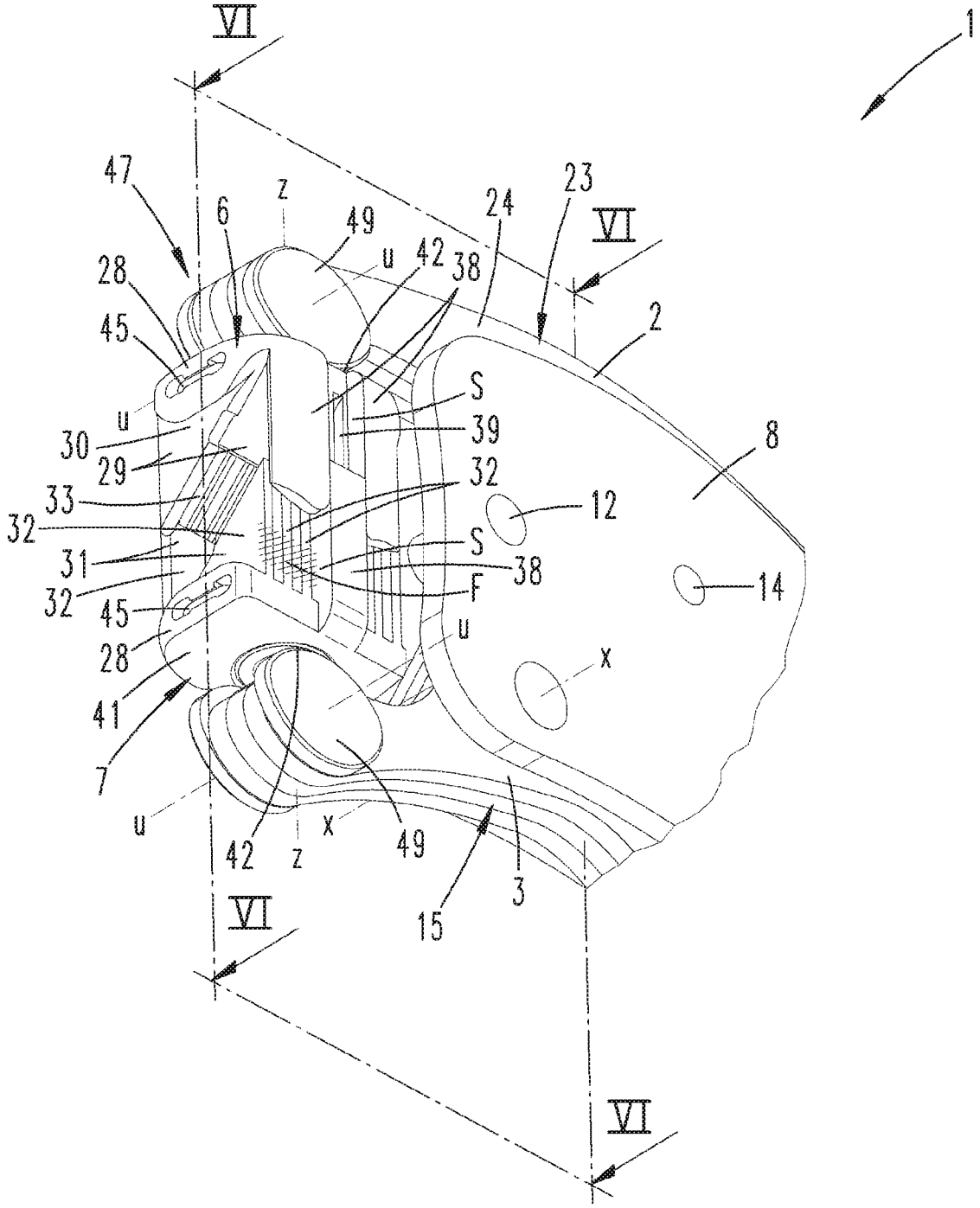
FIG. 5 shows the enlargement of the region V in FIG. 1.
Figure 6:
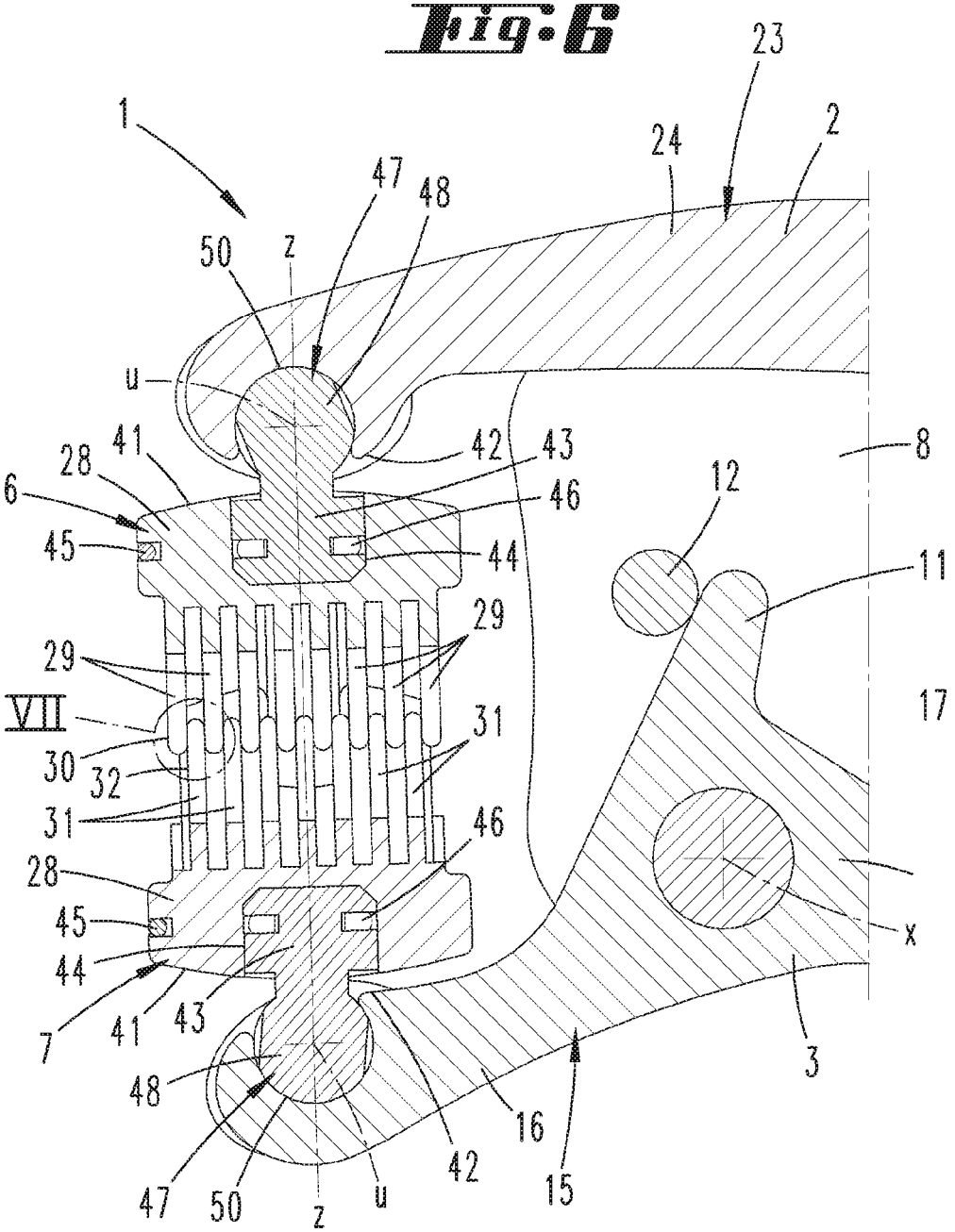
FIG. 6 shows a sectional view according to the plane of intersection VI in FIG. 5.
Figure 11:
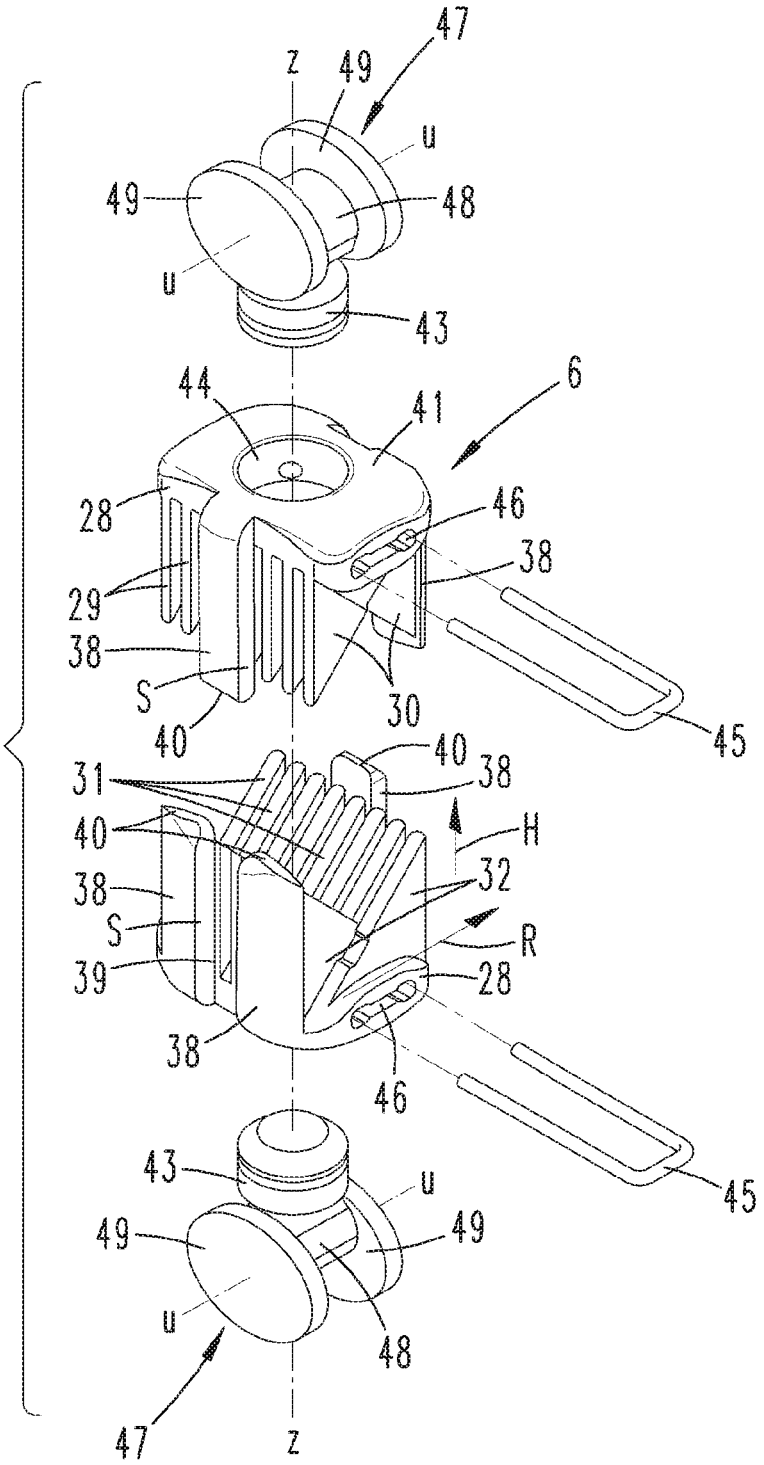
FIG. 11 shows the pressing jaws with associated pivot pin and plug-in parts in a perspective exploded diagram.
Figure 13:
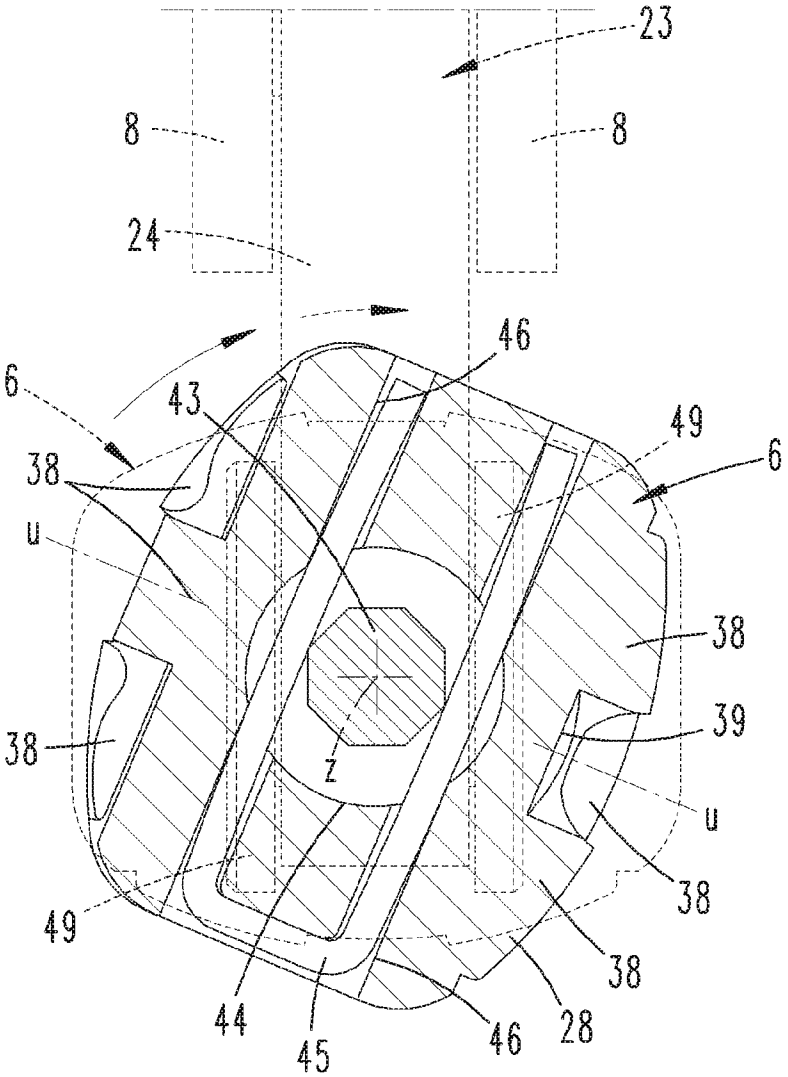
FIG. 13 shows a diagram corresponding to FIG. 12 but in the course of a joint twisting of the pressing jaw pair.
Figure 12:
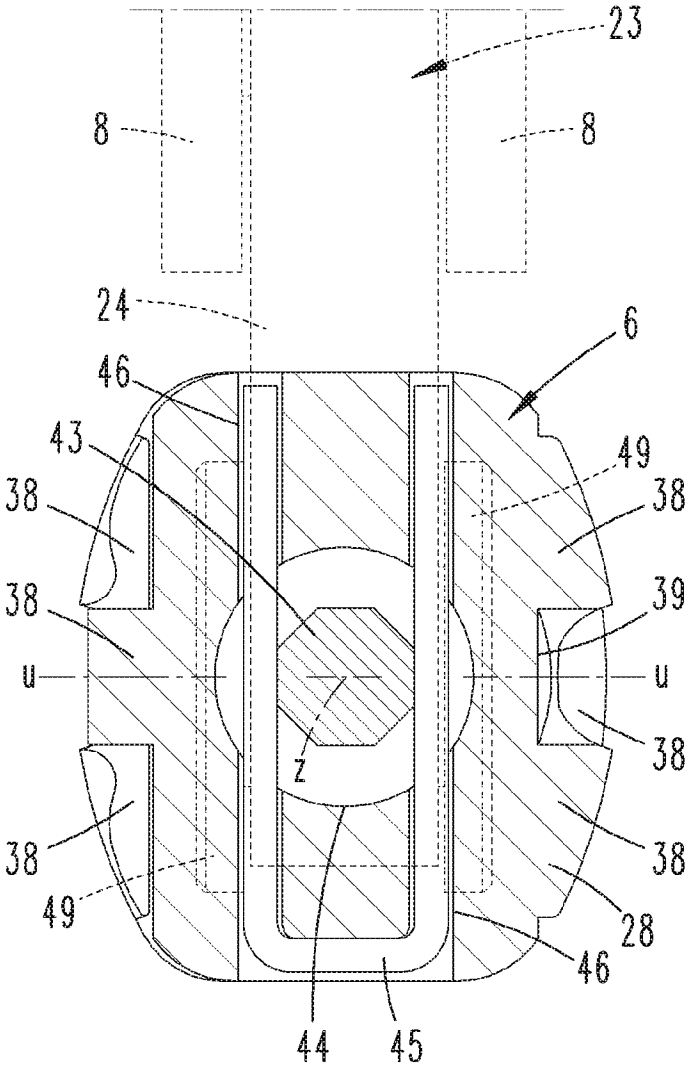
FIG. 12 shows the section according to the line XII-XII in FIG. 4 through the pressing jaw arrangement.
Figure 14:
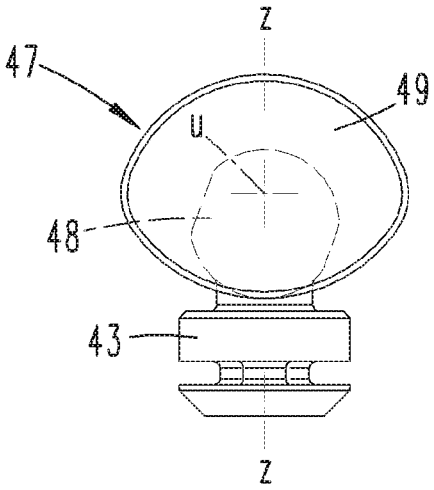
FIG. 14 shows in a detailed diagram a pivot pin configured for holding a pressing jaw.

The pressing jaws 6, 7 are configured for opposite arrangement in the crimping pliers 1. One or two pressing jaws 6, 7 have ribs 29, 31. The ribs 29, 31, according to a profile of their free ends projected on to a base surface, have a rib longitudinal direction R, cf. for example, FIG. 11. During a pressing, the ribs 29, 31 can move into one another, usually over a part of their height H, cf. also FIG. 11. On this matter, reference is also made to FIGS. 6, 7. The region of the ribs 29, 31, which usually comes into engagement with a blank during pressing is designated as working region. Outside the working region of the ribs 29, 31, the ribs 29, 31 have a guide surface F which cooperates with a guide projection 38 starting from the opposite pressing jaw 6, 7. There is therefore a cooperation and therefore also a displacement hindrance or displacement limitation in the rib longitudinal direction. Additionally or alternatively, the guide surface can also be given in the transverse direction to this. In the depicted exemplary embodiment, this is achieved by a corresponding front face S pointing in this direction, possibly opposite on both sides, of a guide projection 38, cf. also on this matter FIG. 5. The guide surface optionally given in the transverse direction serves less as a displacement limitation and more as possibly an additional guide in the sense of a linear guide of the pressing jaws with respect to one another. A relevant displacement limitation is preferably already achieved by the intermeshing ribs.

The pressing jaws 6 and 7 are preferably of the same design, in this case further preferably comprising firstly a base body 28, on which the ribs 29 are arranged, initially with reference to the pressing jaw 6. The ribs 29 and the base body 28 are, as preferred, formed in one piece of the same material.

The ribs 29 of the pressing jaw 6 have the rib longitudinal direction R. With reference to a viewing direction given perpendicular to this rib longitudinal direction R, substantially triangular ribs 29 are obtained in outline, having an outer rib front face 30 running substantially perpendicular to the base body 28 or perpendicular to the rib longitudinal direction R. Starting from this rib front face 30, the front face facing the opposite pressing jaw, which extends in the rib longitudinal direction R, decreases in the direction of the base body 28.

Aligned ribs of a pressing jaw 6 or 7 are arranged spaced apart from one another transversely to the rib longitudinal direction R, in particular with a spacing, which substantially corresponds to the rib thickness viewed in the spacing direction.

Partially further ribs of the same pressing jaw 6 or 7 dip into these spacing regions of the same pressing jaw 6 or 7. With reference to a front view of the pressing jaw 6, in which front view the triangular outline form of the rib 29 is shown, the further ribs 29 engaging in the intermediate spaces of the previously described ribs 29 are arranged substantially as a mirror-image but preferably offset by a rib width, also accordingly having an outer rib front face 30 running substantially vertically to the base body 28, which lie opposite to the rib front faces 30 of the previously described ribs 29. These further ribs 29 also decrease in the rib longitudinal direction in the direction of the base body 28.

The opposite pressing jaw 7 has the same design with regard to the configuration and arrangement of the ribs, accordingly comprising triangular ribs 31 with outer rib front faces 32 when viewed with reference to an outline observed from the front side.

The ribs 29 and 31 of the pressing jaws 6 and 7 intermesh in a comb-like manner, wherein as a result of the previously described triangular outline shape of the ribs 29 and 31 and the mirror-image arrangement inside a pressing jaw 6 and 7, regardless of the spacing of the pressing jaws 6 and 7 with respect to one another, as can be seen in FIG. 1, for example, a pressing jaw opening 33 having a preferably quadrangular, further preferably square outline is established. The edge length of the pressing jaw opening 33 is uniformly variable in the course of a varying linear spacing of the pressing jaws 6 and 7 with respect to one another.

Figure 7:
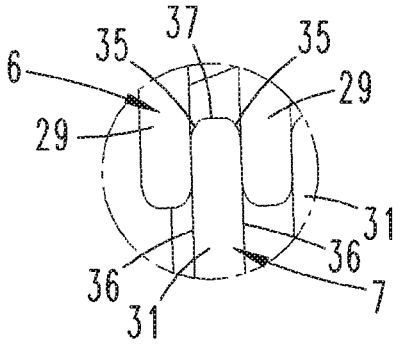
FIG. 7 shows an enlargement of the region VII in FIG. 6.
Figure 9:
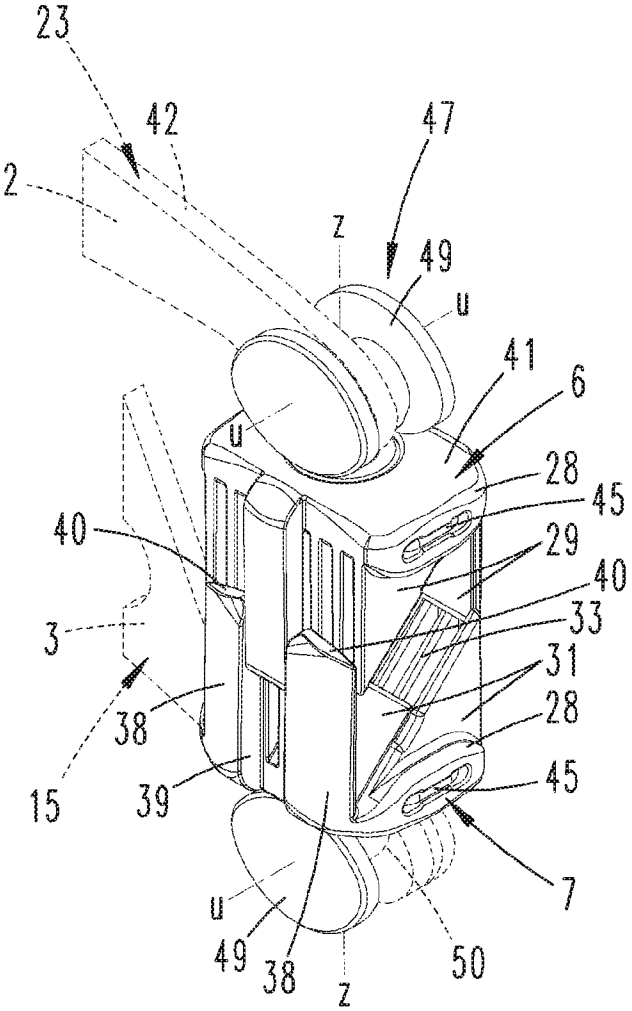
FIG. 9 shows a further perspective diagram of the pressing jaw arrangement viewed in the direction of the arrow IX in FIG. 8.
Figure 8:
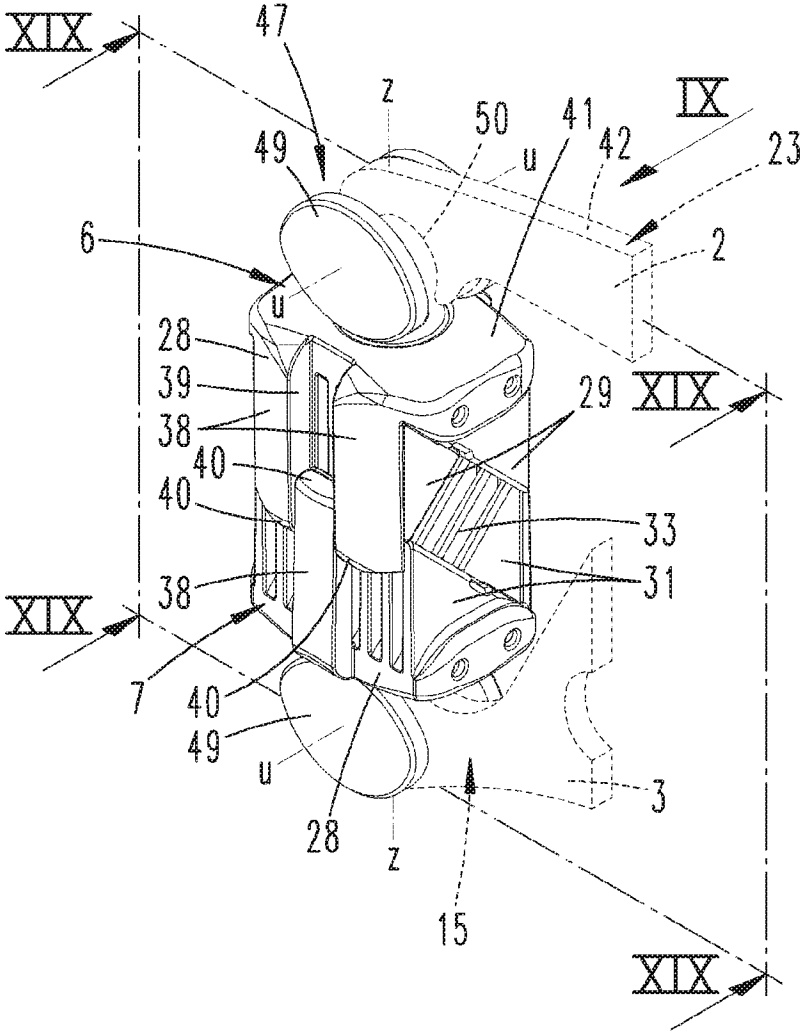
FIG. 8 shows in perspective detailed view the pressing jaw arrangement relating to the pressing jaw open position.
Figure 10:
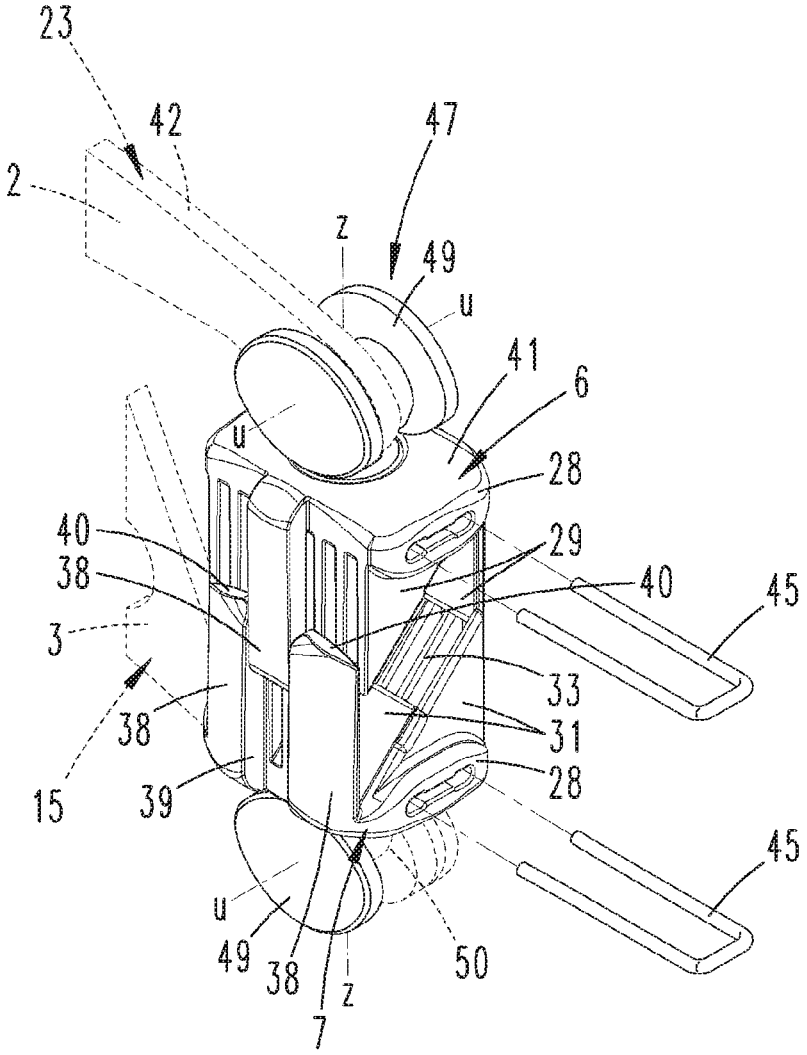
FIG. 10 shows a diagram corresponding to FIG. 9 but after removing plug-in parts which fix the pressing jaws on the crimping pliers.

Facing the other pressing jaw, each rib 29, 31 has a free front face 34 having a rounded contour line 35 in cross-section according to the diagram in FIG. 7, which is obtained transversely to the rib longitudinal direction and which projects furthest at the center. This rounded or curved contour line 35 extends between the flank contour 36 of the rib 29, 31, which preferably extends rectilinearly with reference to a bringing-together direction r of the pressing jaws 6 and 7, wherein furthermore a parallel-running flank contour 36 is preferably provided on both sides with regard to a rib 29, 31. When viewed in the direction of the opposite pressing jaw, preferably an overall concavely curved contour line 35 is obtained.

The curved contour line 35 can extend continuously over the entire rib thickness observed transversely to the rib longitudinal direction, in this case, for example, having a (uniform) radius of curvature, which can correspond to half the rib thickness dimension.

As shown further, the continuous curvature of the contour line 35 can optionally be interrupted by a flattened portion 37, which is approximately central in relation to the cross-section and which co-forms the furthest-projecting region of the rib 29, 31. This can be aligned in relation to the cross-section and optionally run rectilinearly to the flank contour 36.

Transversely to the rib longitudinal direction, upon actuation of the crimping pliers 1, in particular in the course of a pressing to be carried out, a support of the ribs 29 and 31 and therefore accordingly a guidance of the pressing jaws 6 and 7 can be obtained.

Further provided is a guide in particular in the rib longitudinal direction. To this end, each pressing jaw 6, 7 has at least one guide protrusion 38 connected to the respective base body, having a length observed in the bringing-together direction r, which can substantially correspond to the length observed in the same direction of the ribs 29 or 31 arranged on the same base body 28. The guide protrusion 38 extends transversely directed to the rib longitudinal direction over a dimension, which covers the arrangement of two or three ribs 29, 31 in the depicted exemplary embodiment.

The guide protrusion 38 further extends along the associated rib front face 30 or 32.

In the usage position of the pressing jaws 6 and 7, in which the ribs 29 and 31 intermesh, the guide protrusion 38 cooperates with the rib front faces 30 or 32 forming a guide surface.

Such a support via a guide protrusion 38 is provided opposite when viewed in the rib longitudinal direction, wherein the opposite guide protrusions 38 are provided twice on one side leaving a central insertion opening 39 remaining in between and preferably only once on the opposite side for insertion into the central insertion opening of the other pressing jaw 6, 7.

Also as a result, a guidance is additionally provided as a result of abutment of the longitudinal edge surfaces, allocated to one another, of the comb-like cooperating guide protrusions 38 of the two pressing jaws.

In order to further improve the crimping pliers 1 in particular in terms of handling technique, the pressing jaws 6 and 7 are rotatable jointly about a twist axis z in the usage position grasped between the stationary pliers jaw 2 and the movable pliers jaw 3, which twist axis is directed in the bringing-together direction r and transversely to the geometric axes of rotation x and y of the movable pliers jaw 3 or the movable handle part 5.

Figure 2:
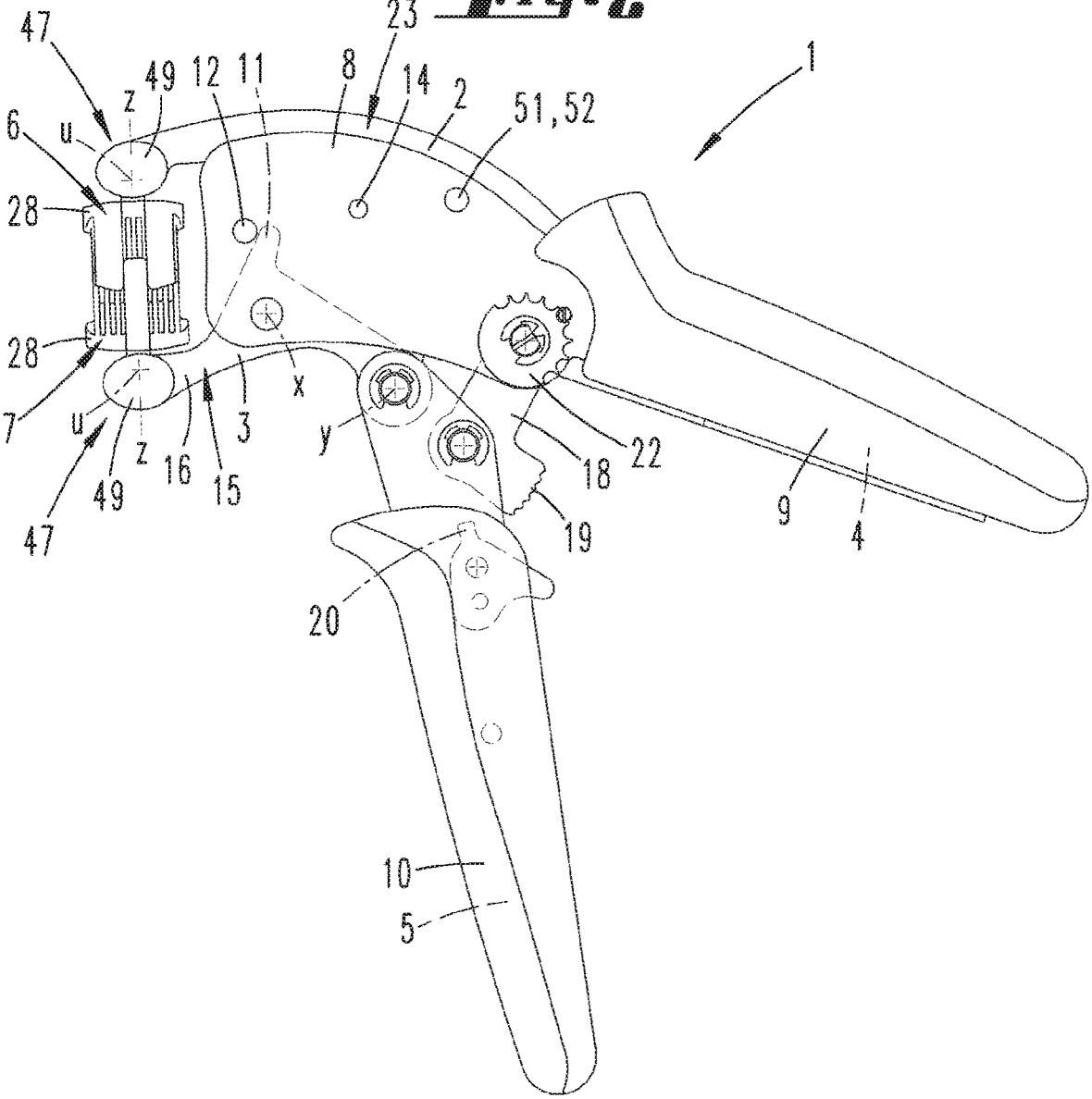
FIG. 2 shows the side view to this.
Figure 3:
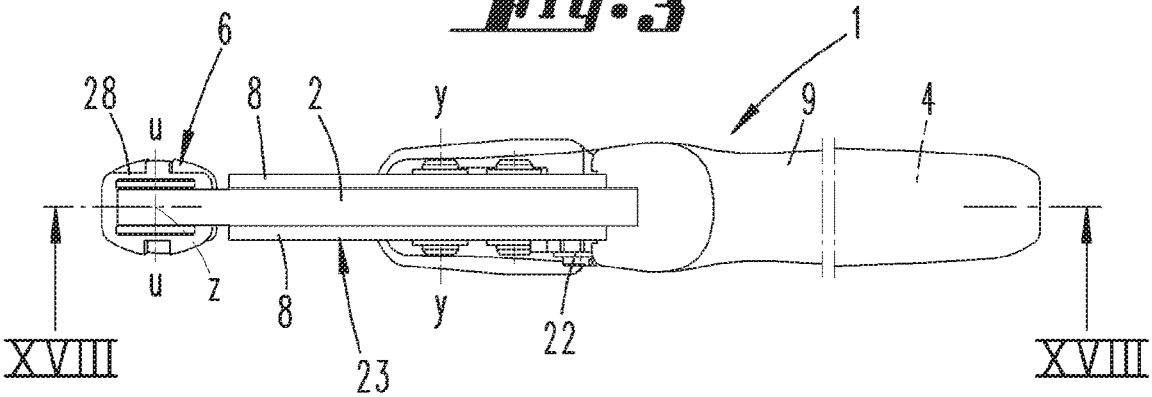
FIG. 3 shows the crimping pliers in plan view.
Figure 4:
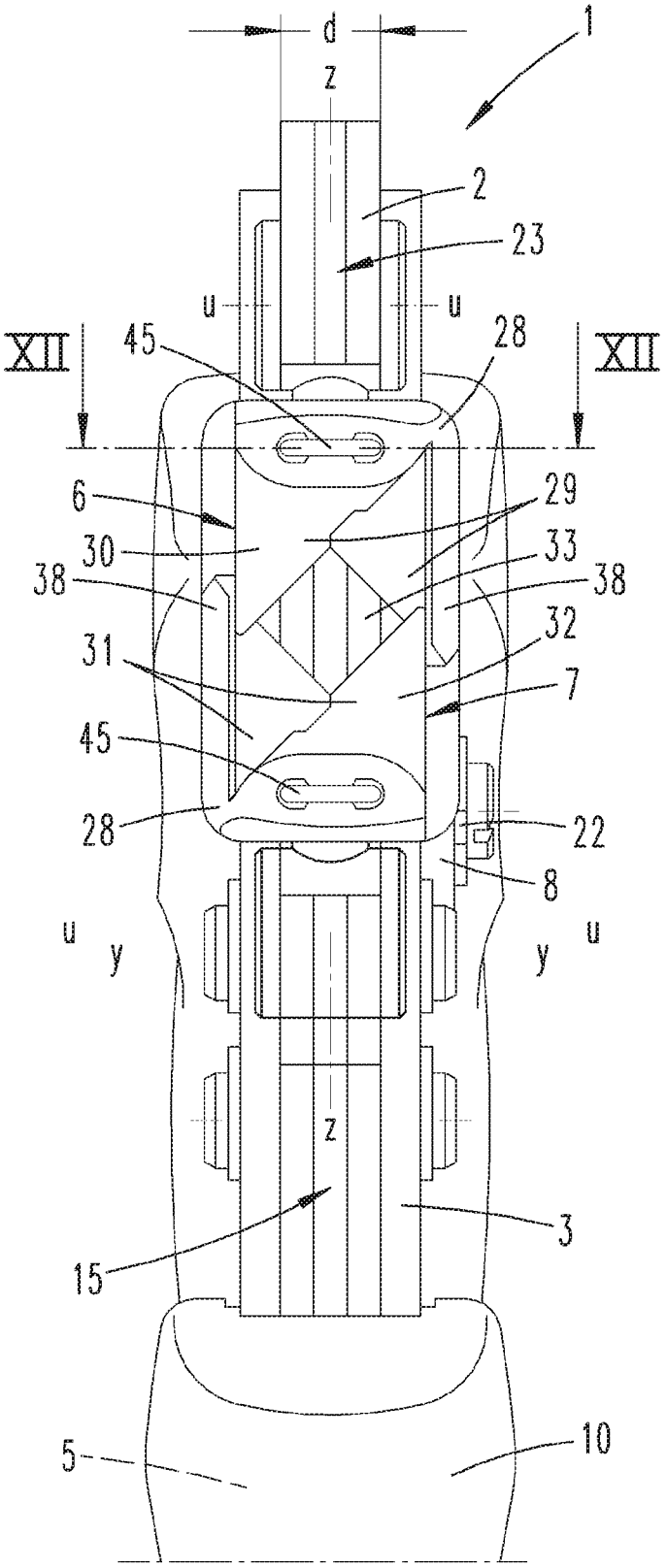
FIG. 4 shows an enlarged front view toward the crimping pliers.
Figure 28:
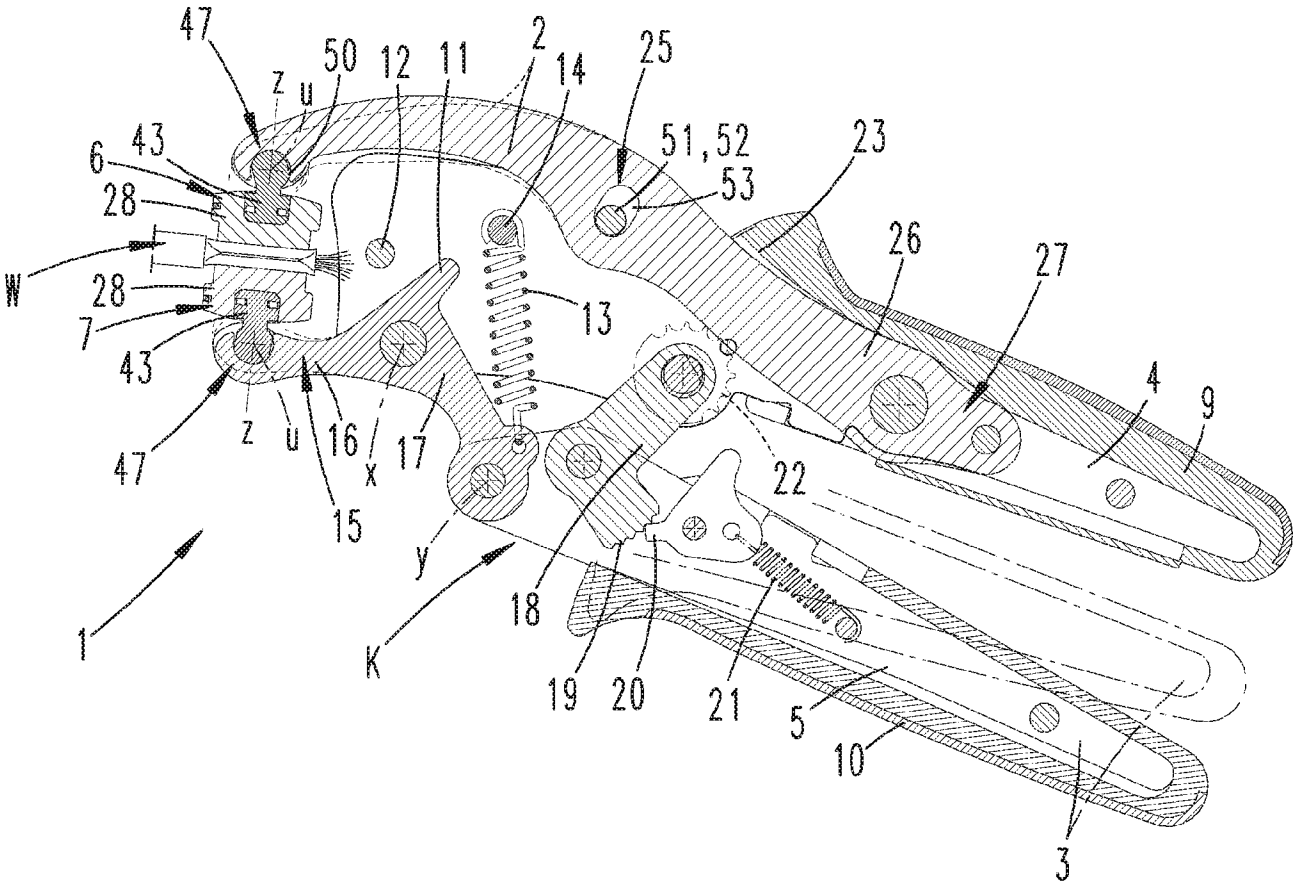
FIG. 28 shows a follow-up diagram to FIG. 26 in the course of the further pressing process during further resilient bending of the holder part.

This possible twisting is independent of the bringing-together position of the pressing jaws 6 and 7, i.e. both in the pressing jaw basic position, for example, according to the diagram in FIG. 2 and further also in a crimping pliers end position, for example, according to the diagram in FIG. 28, and furthermore also in each intermediate position between the basic position and the end position.

This twistability about the twist axis z also in a bringing-together position in which the pressing jaws 6 and 7 are moved completely into one another, which theoretically is only possible when no workpiece to be pressed lies in the pressing jaw opening 33, is substantially achieved whereby the surface 40, facing the opposite pliers jaw, of a guide protrusion of the pressing jaw arranged on the opposite pliers jaw does not go beyond a lower surface 41 of the base body 28 of the opposite pressing jaw in this bringing-together position. Accordingly, there is always a distance between the surface 40 of the guide protrusion 38 and the facing surface 42 of the pliers jaw, toward which the guide protrusion 38 approaches.

In order to achieve the twistability, a pivot pin 43 assigned to each pressing jaw 6 or 7 is initially provided. This sits, passing through the lower surface 41, in a shape-adapted recess 44 of the base body 28 of the pressing jaw 6, 7. The pressing jaw 6, 7 is rotatable about the twist axis z relative to the pivot pin 43, whereas the pivot pin 43 is preferably received non-displaceably in relation to the twist axis z in the respectively assigned end of the pliers jaw 2, 3 or the lever part 15 or holder part 23.

The pressing jaw 6 or 7 can be held dismountably on the respective pivot pin 43. For this purpose, in the depicted exemplary embodiment a U-shaped plug-in part 45 is provided, which can optionally be plugged in or removed from the front side forming the pressing jaw opening 33 transversely to the twist axis z. For this purpose, two channels 46 running parallel and transversely to the twist axis z are provided in the base body 28 of the pressing jaw 6, 7, through which channels the U-legs of the plug-in part running preferably parallel to one another in the unloaded state can be inserted. The channels 46 thereby traverse the recess 44 substantially receiving the pivot pin 43 (cf. FIG. 11).

The pivot pin 43 can be provided with a polygonal cross-section at least in the section cooperating with the plug-in part 45, in the depicted exemplary embodiment in the form of an octagon. The U-legs of the plug-in part 45 abut against two opposite flat sides of the pivot pin 43 formed as polygonal here with respect to the twist axis z. A positive receipt of the plug-in part 45 both in the pressing jaw 6, 7 and also on the pivot pin 43 is thus given, since the previously described polygonal configuration is formed in particular in a constricted-diameter region of the pivot pin 43, accordingly the U-legs lie in the circumferential annular groove thereby formed (cf. also FIG. 6). Accordingly, a rotary latching fixing in several rotational positions can thus be achieved.

By pulling out the plug-in part 45, which in a further embodiment is preferably configured to be resilient, the pressing jaw 6, 7 can be released from the pivot pin 43 to remove the pressing jaw 6, 7.

Each pivot pin 43 can furthermore be fastened via a pivot joint 47 to the associated pliers jaw 2, 3 or to the associated lever part 15 or holder part 23. The geometric pivot axis u is transversely directed to the twist axis z, optionally as is also preferred, aligned parallel to the geometric axes of rotation x and y of the movable pliers jaw 3 and/or the movable handle part 5.

For this purpose, pivot pin 48 is molded on the pivot pin 43 in extension of the sections received in the base body 28 of the pressing jaw 6, 7, which pivot pin can be covered on both sides at the end by guide jaws 49 enlarged compared with the pin diameter.

Figure 15:
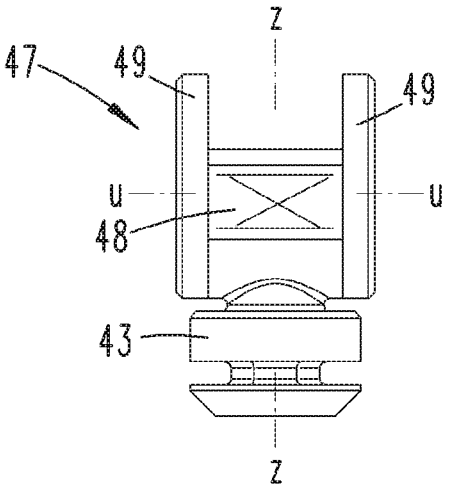
FIG. 15 shows further view of the pivot pin.
Figure 16:
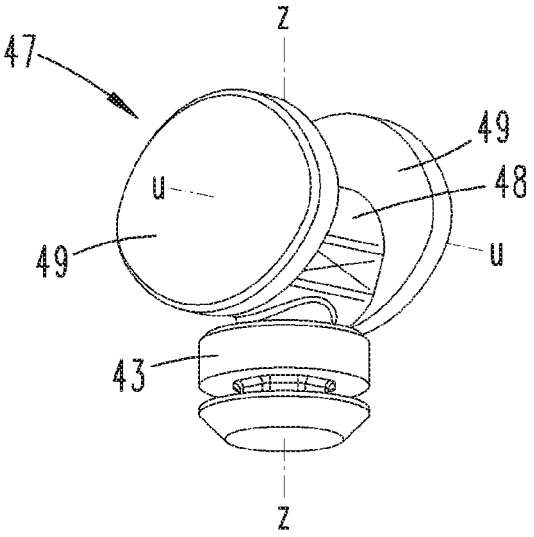
FIG. 16 shows the pivot pin in a perspective diagram.
Figure 17:
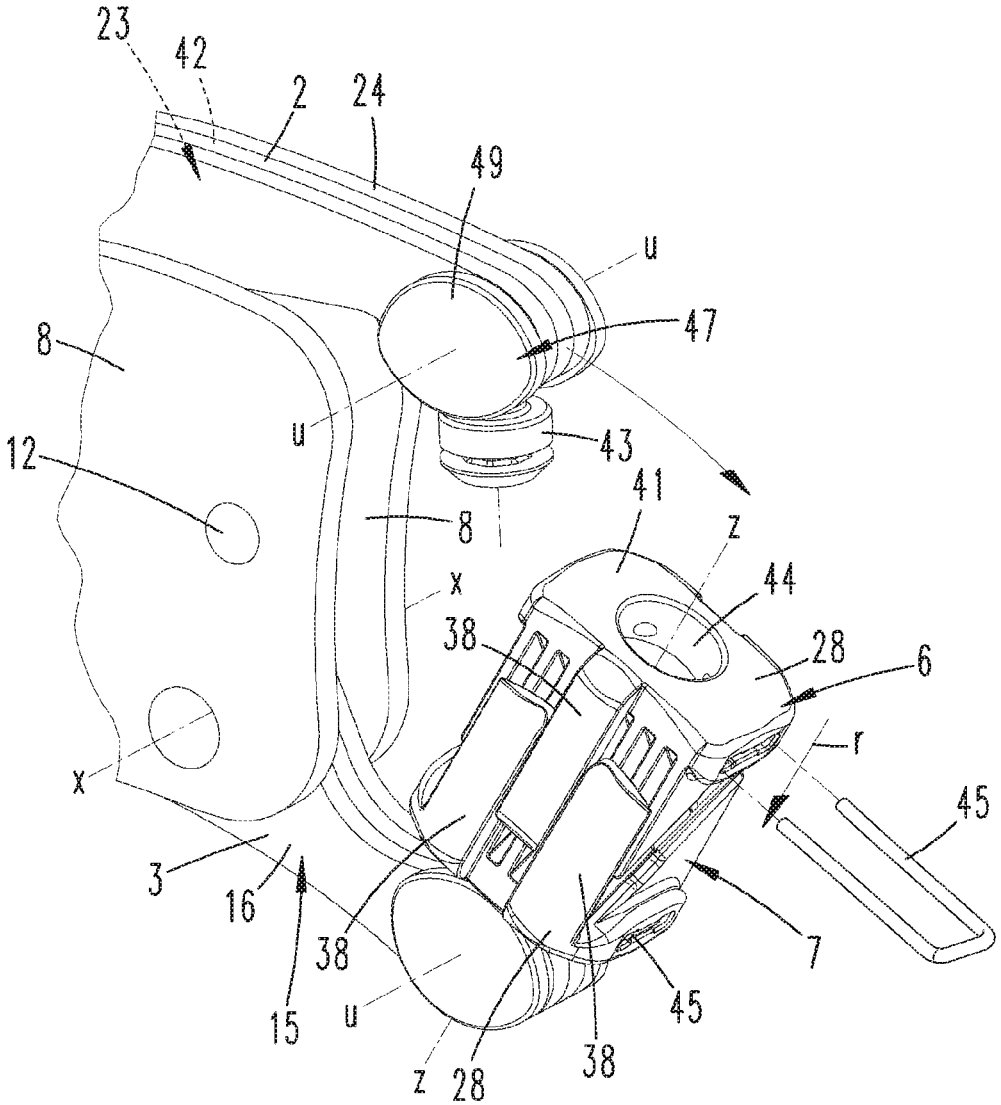
FIG. 17 shows a diagram substantially corresponding to FIG. 9 but after cancelling the holding of a pressing jaw on the appurtenant pivot pin and pivoting away the pressing jaw pair into a removal position.
Figure 18:
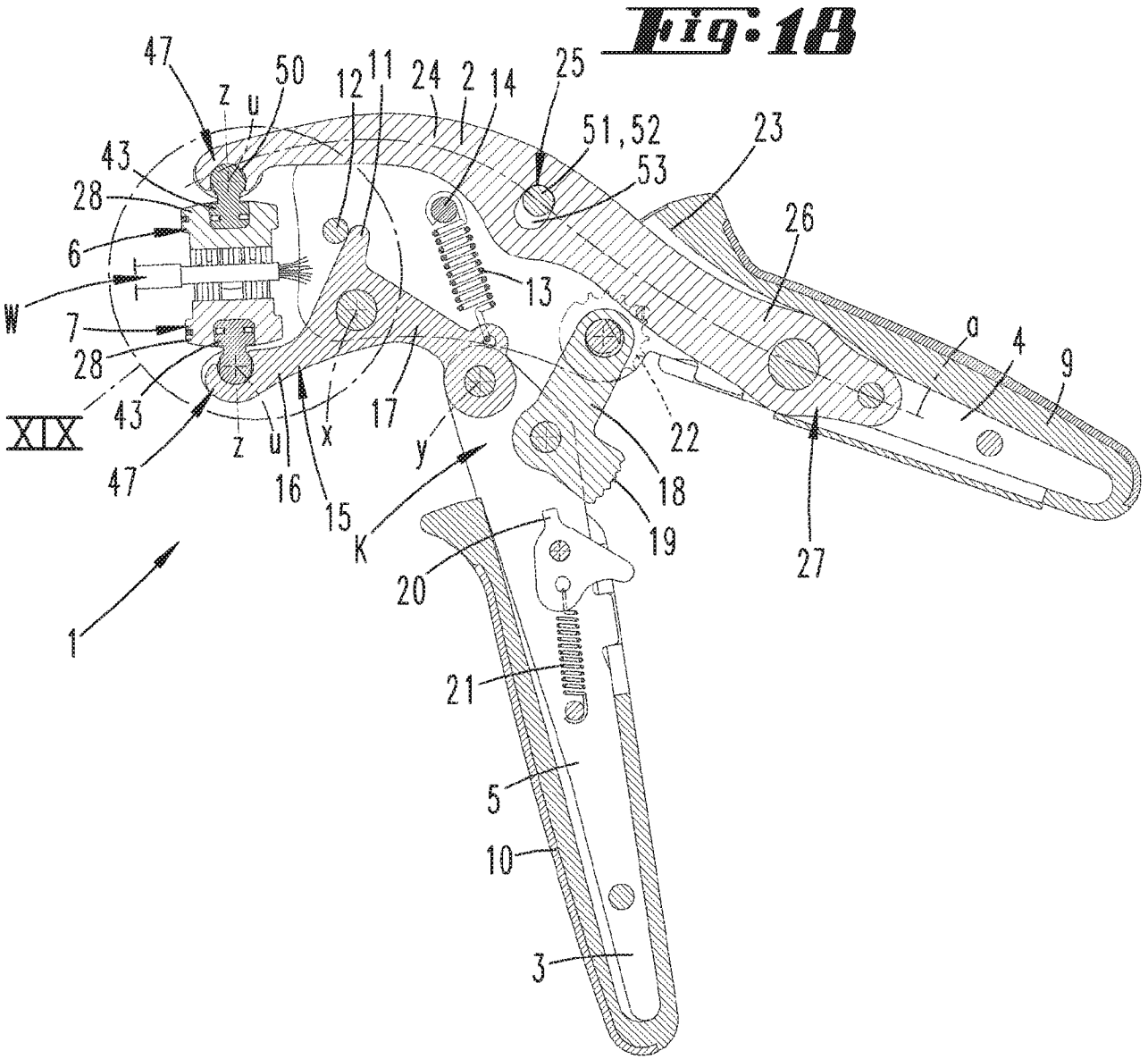
FIG. 18 shows the section according to the line XVIII-XVIII in FIG. 3.
Figure 20:
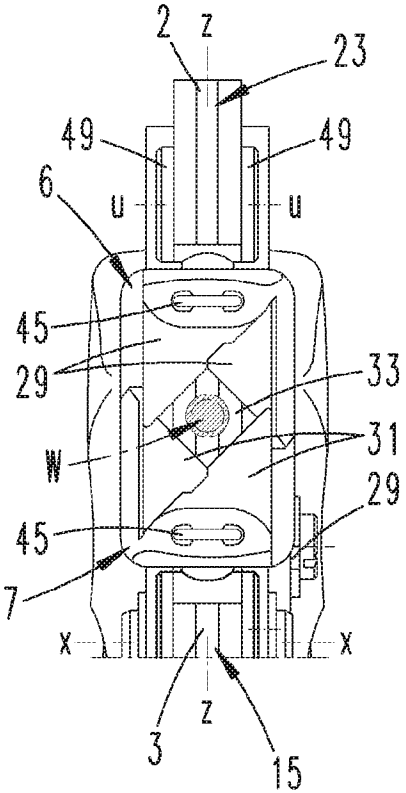
FIG. 20 shows the view according to arrow XX in FIG. 19.
Figure 19:
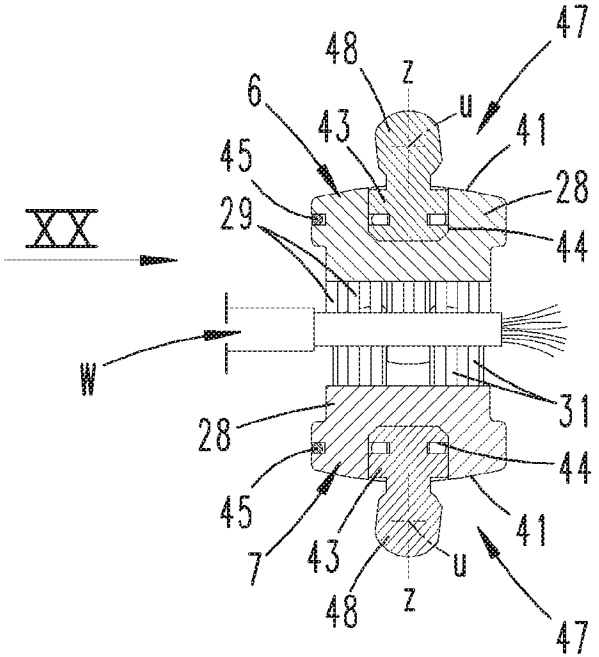
FIG. 19 shows a sectional diagram according to the plane of intersection XIX in FIG. 8 with a workpiece inserted in the pressing mouth relating to a pressing jaw open position.
Figure 21:
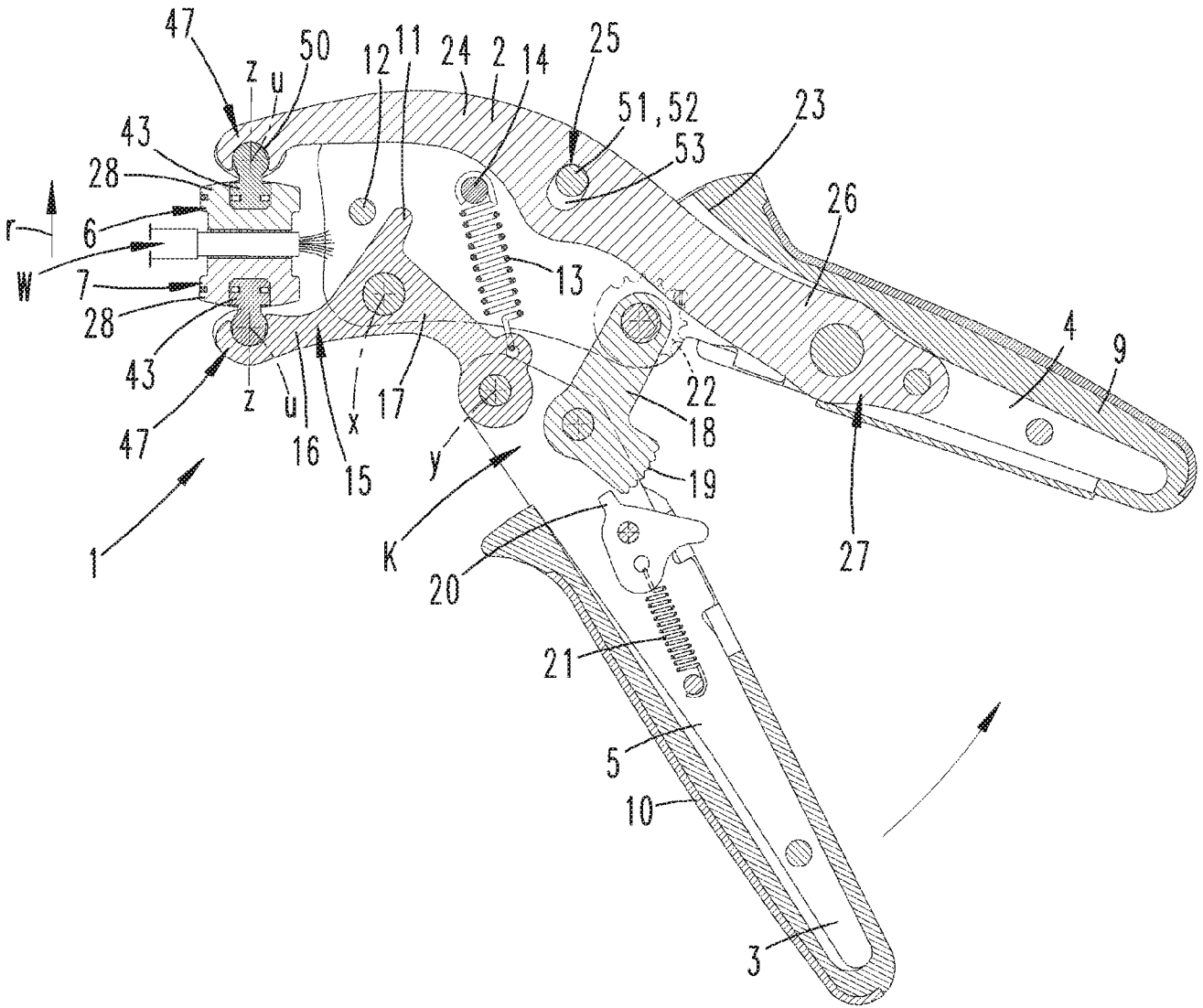
FIG. 21 shows a diagram corresponding to FIG. 18 relating to an intermediate position in the course of a pressing process.
Figure 23:
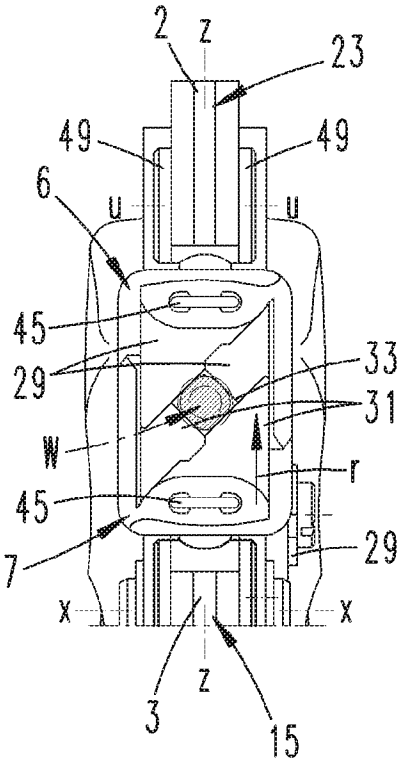
FIG. 23 shows the view according to the arrow XXIII in FIG. 22.
Figure 22:
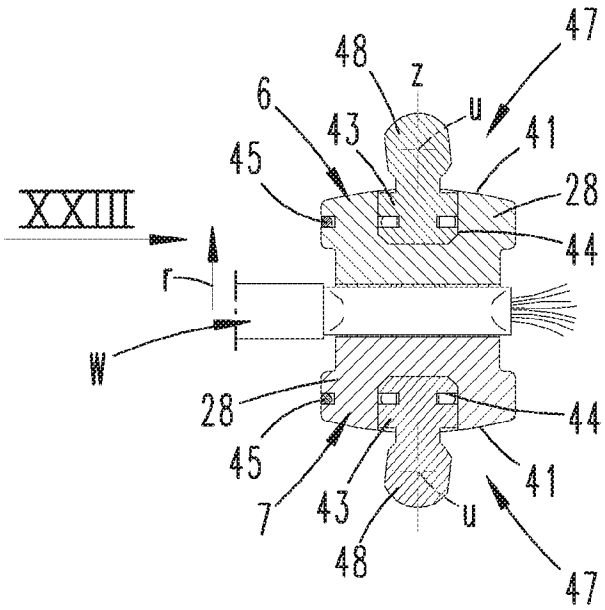
FIG. 22 shows a diagram corresponding to FIG. 19 relating to the pressing intermediate position according to FIG. 21.
Figure 25:
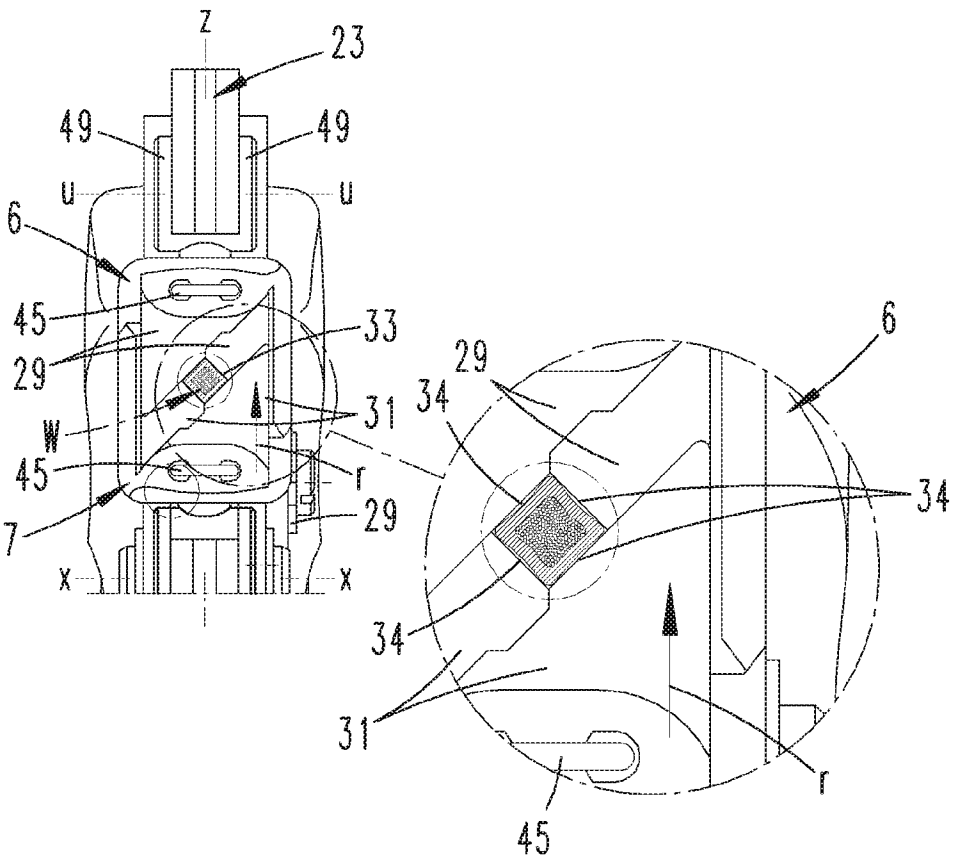
FIG. 25 shows the view according to arrow XXV in FIG. 24 with further a magnifying-glass-like enlarged diagram.
Figure 24:
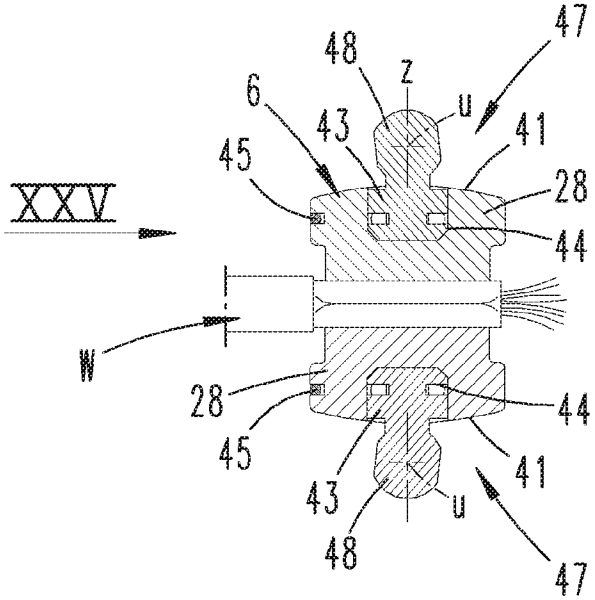
FIG. 24 shows a follow-up diagram to FIG. 22 in the course of a further pressing jaw displacement.
Figure 26:
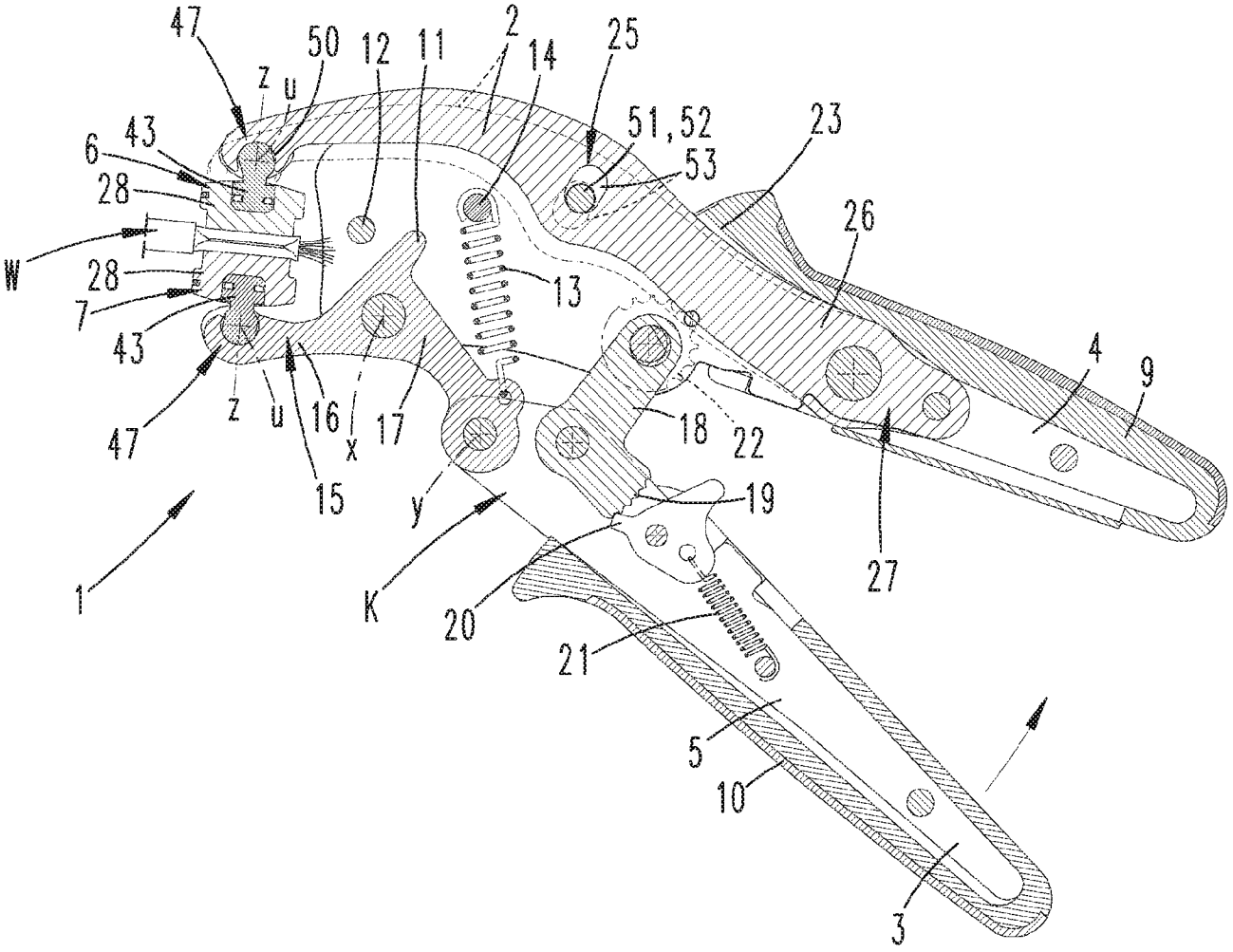
FIG. 26 shows a follow-up diagram to FIG. 21 relating to an intermediate position under a first bending deflection of a holder part acting on a pressing jaw.
Figure 27:
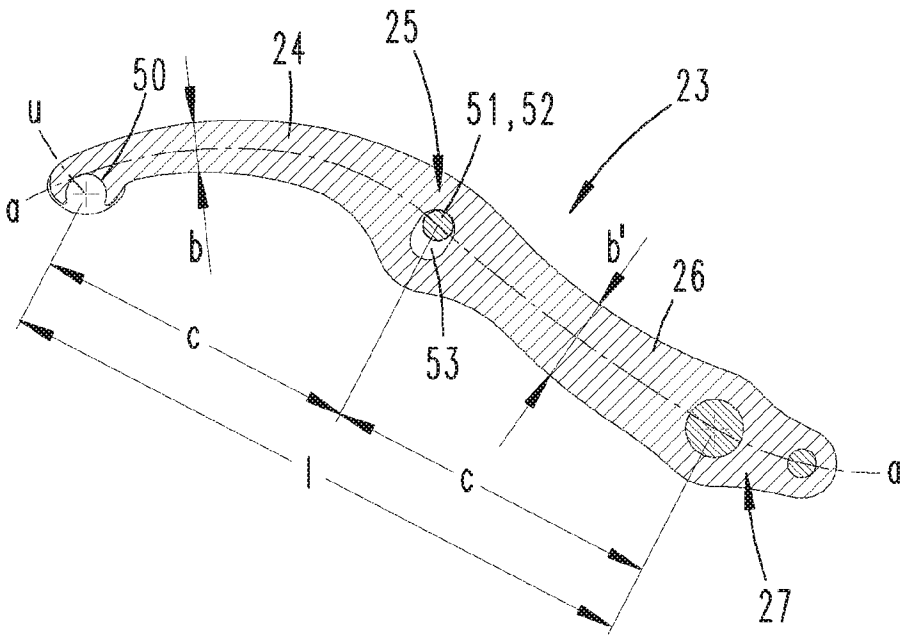
FIG. 27 shows the holder part in an individual diagram.

The respective pivot pin 48 is received in a shape-matched cavity 50 of the associated pliers jaw 2, 3 or the associated lever part 15 or holder part 23, which cavity 50 preferably extends in the cross-section according to the diagram in FIG. 15 over half the circumferential extension of the pivot pin 48 in order to thus provide a captive holding of the pivot pin 43.

In connection with the previously described pivotability about the pivot axis u given here and the dismountability of the pressing jaws 6, 7 from the respective pivot pin 43, it is possible to remove the pressing jaws 6, 7 in a favorable manner in terms of handling and to equip with these. Thus, for example, for removal, firstly the plug-in part 45 of the first pressing jaw 6 associated with the stationary pliers jaw 2 can be removed, whereafter the first pressing jaw 6 can be displaced in the direction of the bringing-together direction r onto the opposite second pressing jaw 7 with combing interaction of the ribs 29 and 31. The pivot pin 43 thereby leaves the recess 44, whereafter the pressing jaw pair overall can be pivoted forward about the pivot axis u of the second pressing jaw 7 associated with the movable pliers jaw 3, for example, by a pivot angle of about 15° to 30°. In this position, but also already possible previously, the further plug-in part 45 of the second pressing jaw 7 can be removed, after which the pressing jaw pair overall can be removed from the pivot pin 43 of the second pressing jaw 7. The mounting of a pressing jaw pair is accomplished in the reverse order.

Also the second pressing jaw 7 can be initially released from the appurtenant pivot pin 43 and then displaced in the direction of the first pressing jaw 6, after which the pressing jaw pair is pivoted out forward about the pivot axis u of the first pressing jaw 6, the first pressing jaw 7 is released from the pivot pin 43, and then the pressing jaw pair thus released is removed.

In the case of one of the pliers jaws, the stationary pliers jaw 2, the associated pressing jaw 6 is connected to the stationary pliers jaw 2 by means of the holder part 23 already discussed. The holder part 23 is fundamentally resilient in the sense that it can deviate contrary to the pressing direction in a resilient manner. In the connecting region of the fixed connection during a pressing with the crimping pliers, there is none or almost no relative movement between the holder part 23 and the stationary pliers jaw 2.

The holder part 23 can also move relative to the stationary pliers jaw 2 during a pressing. The movement is achieved at least substantially due to an elastic deformation in view of the forces acting on the pressing jaw 6 during the pressing, which are received by the holder part 23. However, this movability is restricted as a result of a stop, which is formed on the holder part 23 and/or the stationary pliers jaw 2 and with corresponding introduction of force or deformation of the holder part 23, results in a stop connection between the holder part 23 and the stationary pliers jaw 2. When this stop connection is achieved, a shortening of the resilient region of the holder part 23 is obtained as it were. During a further action of force, the holder part 23 no longer deviates elastically by a corresponding amount, by which it had deviated previously with a corresponding amount of force. Nevertheless however, a further resilience is still achieved.

The stop connection 25 provided in the region of the holder part 23 associated with the stationary pliers jaw 2 is given by a stop, which is formed specifically and preferably by a stop section 51. The stop can come to abut against a marginal edge of the holder part 23. Preferably and in the exemplary embodiment, it is shown that the holder part 23 has a slot 53, in which the stop, here preferably in the form of a pin 52, is received. In the given case, when it is provided in this respect, the slot 53 extends with its central axis directed in the longitudinal direction substantially approximately perpendicular to the previously described central line a of the holder part 23.

The slot 53 has a width matched to the diameter of the pin 52, whereas the length observed perpendicular thereto can approximately correspond to 1.5 times to approximately twice the pin diameter.

The holder part 23 is suitable for bending deformation in the course of an application of pressing force, in particular for a bending deformation substantially contrary to the bringing-together direction r and transversely to the central line a. In the course of this bending deformation, which is initially and substantially obtained as a result of the clamping in the region of the fixed connection 27 to the pliers jaw 2, the slot 53 in the holder part 23 can come to abut against the stop section 51 or the pin 52. The holder part 23 only experiences a support in this abutment position in the region of the stop connection 25 which, in the course of a further introduction of pressing force, for example, during a pressing of larger-diameter workpieces W, brings about a predominant bending stress of the holder part 23 possibly merely in the holder part section 24.

The holder part 23 is preferably configured as a flat part having a smaller thickness d compared with its length 1. In the depicted exemplary embodiment, the length approximately corresponds to 15 to 30 times, further approximately 20 times the thickness d. The holder part preferably also abuts almost directly against a corresponding flat side of the stationary pliers jaw 2.

Furthermore, in particular in the respectively central region, in any case in the respectively central length third, of the holder part section 24 and the holder part section 26, a smallest cross-section b, b' observed transversely to the central line a is obtained. The smallest cross-section (dimension b') between the fixed connection 27 and the stop connection 25 is in this case preferably larger than the smallest cross-section (dimension b) between the stop connection 25 and the holder region for the first pressing jaw 6. The dimension of the smallest cross-section 6 between the stop connection 25 and the pressing jaw holder can correspond to 0.3 to 0.8 times the dimension of the smallest cross-section b' between the stop connection 25 and the fixed connection 27.

In the depicted exemplary embodiment, when viewed in the direction of extension of the central line a starting from the holder region for the first pressing jaw 6 in the direction of the stop connection 25 passing through over half to ⅔ of the relevant length of the holder part section 24, a smaller cross-sectional dimension b is given compared with the cross-sectional dimension b' over the entire extension length of the holder part section 26 extending between the stop connection 25 and the fixed connection 27. Accordingly, a region of greatest deformation can be obtained in the holder part section 24 between the stop connection 25 and the holder region for the first pressing jaw 6.

As a result, a favorable force-path compensation is made possible in order to be able to press workpieces W having different diameters without changing the pressing jaws 6 and 7. The respective lever travel in particular of the handle part 5 is independent of the workpiece diameter right into a position, in which the pawl 20 leaves the ratchet section 19. The movable handle part 5 released as a result can be pivoted back while opening or distancing the pressing jaws 6 and 7 from one another.

Furthermore, the force-path compensation is supported as a result of a possible bending deformation in the region of the lever part 15 assigned to the movable pliers jaw 3 or directly forming this pliers jaw 3, thus in particular in the lever section 16 obtained between the axis of rotation x and the pivot joint 47 of the associated second pressing jaw 7, which, when viewed transversely to the essential longitudinal extension thereof, has a smaller minimal cross-sectional dimension than the lever section 17 between the axis of rotation x and the pivot connection of the movable handle part 5.

REFERENCE LIST

1 Crimping pliers
2 Pliers jaw
3 Pliers jaw
4 Handle part
5 Handle part
6 Pressing jaw
7 Pressing jaw
8 Jaw part
9 Handle sleeve
10 Handle sleeve
11 Stop section
12 Pin
13 Spring
14 Pin
15 Lever part
16 Lever section
17 Lever section
18 Ratchet arm
19 Ratchet section
20 Pawl
21 Tension spring
22 Actuator
23 Holder part
24 Holder part section
25 Stop connection
26 Holder part section
27 Fixed connection
28 Base body
29 Rib
30 Rib front face
31 Rib
32 Rib front face
33 Pressing jaw opening
34 Front face
35 Contour line
36 Flank contour
37 Flattened portion
38 Guide protrusion
39 Insertion opening
40 Surface
41 Lower surface
42 Surface
43 Pivot pin
44 Recess

45 Plug-in part
46 Channel
47 Pivot joint
48 Pivot pin
49 Guide jaw
50 Cavity
51 Stop section
52 Pin
53 Slot
a Central line
b Cross-section
b' Cross-section
c Distance
d Thickness
l Length
r Bringing-together direction
u Pivot axis
x Axis of rotation
y Axis of rotation
z Twist axis
K Knee joint arrangement
W Workpiece

The invention claimed is:

1. Crimping pliers (1) for crimping workpieces (W), the crimping pliers comprising:

two oppositely arranged pressing jaws (6, 7) in the form of a first pressing jaw (6) and a second pressing jaw (7), and two pliers jaws (2, 3), wherein one pliers jaw (2) of the two pliers jaws (2, 3) is stationary and the first pressing jaw (6) is fastened to the stationary pliers jaw (2) by means of a spring-loadable holder part (23) with a length extending between a pressing-jaw-side end of the holder part (23) facing the first pressing jaw (6) and an end of the holder part (23) facing away from the first pressing jaw (6), wherein the holder part (23) is fixedly connected to the stationary pliers jaw (2) via a fixed connection (27) at the end of the holder part (23) facing away from the first pressing jaw (6), wherein a stop connection (25) is formed between the stationary pliers jaw (2) and the holder part (23) between the fixed connection (27) and the pressing-jaw side end of the holder part (23), wherein the stop connection is activated when a pre-determined pressing force between the pressing jaws (6, 7) is exceeded, and during a crimping, the holder part (23) is initially bendable in a restorable manner over its entire length between the fixed connection and the pressing-jaw-side end as a result of an intrinsic elasticity of a material of the holding part, wherein when the stop connection (25) is activated, a further action of a pressing force between the pressing jaws (6, 7) results in a greater bending in a holder part section (24) of the holder part (23) between the stop connection (25) and the pressing-jaw-side end than in a holder part section (26) of the holder part (23) between the stop connection and the fixed connection.

2. The crimping pliers as claimed in claim 1, wherein the stop connection (25) is formed by a stop section (51) of the stationary pliers jaw (2), which comes to abut against the holder part (23) as a result of a bending deformation of the holder part (23) in the course of an application of the pressing force.

3. The crimping pliers as claimed in claim 2, wherein the stop section (51) is configured as a pin (52) received in a slot (53) of the holder part (23).

4. The crimping pliers as claimed in claim 2, wherein a smallest cross-section (b') of the holder part (23) between the fixed connection (27) and the stop section (51) is larger than a smallest cross-section between the stop section (51) and a holder region of the holder part (23) connected to the first pressing jaw (6).

5. The crimping pliers as claimed in claim 4, wherein in a region between ⅓ and ⅔ of a distance (c) between the stop section (51) and the fixed connection (27) or in a region between ⅓ and ⅔ of a distance (c) between the holder region and the stop section (51), an effective bending cross-section of the holder part (23) is 10% or more larger than in a region of a smallest cross-section of the entire length of the holder part (23).

6. The crimping pliers as claimed in claim 1, wherein the holder part (23) is configured as a flat part having a smaller thickness (d) compared with its length (l).

7. The crimping pliers as claimed in claim 1, wherein the pliers jaw (3) other than the stationary pliers jaw (2) is movable and wherein in an unloaded state with respect to a central longitudinal line (a), the holder part (23) has a concave profile when viewed from the movable pliers jaw (3).

8. The crimping pliers as claimed in claim 7, wherein the movable pliers jaw (3) is mounted on the stationary pliers jaw (2) and on a movable handle part (5) by means of a continuously uniform-material lever part (15) and the lever part further has a free end region for holding receipt of the second pressing jaw (7).

9. The crimping pliers as claimed in claim 8, wherein in relation to the lever part (15) in a region between ⅓ and ⅔ of a distance between the mounting of the lever part (15) on the stationary pliers jaw (2) and the mounting of the lever part (15) on the movable handle part (5) or between the mounting of the lever part (15) on the stationary pliers jaw (2) and the free end region of the lever part, a region of greatest deformation of the lever part can be obtained when the pressing force is applied.

* * * * *